US005350014A

United States Patent [19]

McKay

[11] Patent Number: 5,350,014

[45] Date of Patent: Sep. 27, 1994

[54] CONTROL OF FLOW AND PRODUCTION OF WATER AND OIL OR BITUMEN FROM POROUS UNDERGROUND FORMATIONS

[75] Inventor: Alexander S. McKay, South Lake Tahoe, Calif.

[73] Assignee: Alberta Oil Sands Technology and Research Authority, Edmonton, Canada

[21] Appl. No.: 842,059

[22] Filed: Feb. 26, 1992

[51] Int. Cl.[5] ..... E21B 43/24

[52] U.S. Cl. ..... 166/263; 166/272; 166/303; 166/306

[58] Field of Search ..... 166/263, 272, 303, 306

[56] References Cited

U.S. PATENT DOCUMENTS 4,475,592 10/1984 Pachovsky ..... 166/272
4,846,275 7/1989 McKay ..... 166/272
4,884,635 12/1989 McKay et al. ..... 166/272 X
5,056,596 10/1991 McKay et al. ..... 166/272
5,145,002 9/1992 McKay ..... 166/272

*Primary Examiner*—George A. Suchfield
*Attorney, Agent, or Firm*—Cooper & Dunham

[57] ABSTRACT

It has been discovered that the production or recovery of oil or bitumen produced or recovered in the form of an oil-in-water emulsion form a porous water containing oil or bitumen producing formation is maintained and improved by maintaining the temperature of the produced oil or bitumen in the form of an oil-in-water emulsion at a temperature not lower than and preferably greater than Tc, wherein Tc is the minimum temperature for the oil or bitumen, such as in the form of an oil-in-water emulsion, to flow through the porous water-containing oil or bitumen producing formation. In a special practice of this invention to prevent water coning, a substantially water impermeable barrier can be produced in a water saturated formation by depositing therein a bitumen or oil-in-water emulsion barrier or zone at a temperature below Tc.

14 Claims, 21 Drawing Sheets

CONTROL OF FLOW AND PRODUCTION OF WATER AND OIL OR BITUMEN FROM POROUS UNDERGROUND FORMATIONS

BACKGROUND OF THE INVENTION

This application is related to co-pending, co-assigned patent application Ser. No. 657,434 filed Feb. 19, 1991, now U.S. Pat. No. 5,145,002, which is a continuation of application Ser. No. 345,103 filed Apr. 28, 1989, now abandoned, which is a division of application Ser. No. 152,933 filed Feb. 5, 1988, now U.S. Pat. No. 4,846,275.

The production and recovery of oil or bitumen from underground formations has long been carried out. Production difficulties arise, however, in connection with the production of heavy oil or bitumen from oil or bitumen producing formations which also contain and/or produce water. Difficulties have also been encountered in secondary recovery operations for the recovery of heavy oil or bitumen from underground formations wherein aqueous fluids, such as steam and/or hot water, have been introduced to move heavy oil or bitumen within a heavy oil or bitumen containing formation to a production well for recovery.

Difficulties which have been experienced in oil or bitumen recovery operations have included the production of an excessive amount of aqueous fluids relative to the amount or produced oil of bitumen. Such difficulties may be caused by channeling or preferential movement of an aqueous fluid, such as steam or water, through an oil or bitumen containing formation with substantially no movement or transport of the oil or bitumen therewith.

It is an object of this invention to provide a technique for the increased production of oil or bitumen from underground formations, particularly from underground formations wherein water is produced along with the produced oil of bitumen.

It is another object of this invention to provide an improved technique for the recovery of heavy oil or bitumen from underground formations, such as in tar sands and the like, wherein aqueous fluids, such as steam and/or hot water or mixtures thereof, are introduced concomitantly or sequentially to drive or displace and transport the oil or bitumen in the underground formation to a producing well.

Still another object of this invention is to provide a technique embodying a practice of this invention to prevent and/or to overcome water coning in a petroleum producing formation wherein petroleum is produced from an underground formation in contact with or in the presence of water.

How these and other objects of this invention are achieved will become apparent in the light of the accompanying disclosure made in connection with the accompanying drawings. In at least one embodiment of the practices of this invention at least one of the foregoing objects will be achieved.

IN THE DRAWINGS

In the accompanying drawings, FIG. 1 schematically illustrates a practice of this invention wherein an oil or bitumen producing formation which has undergone water coning is treated to overcome or prevent water coning;

FIG. 2 schematically illustrates another technique similar to that illustrated in FIG. 1 in accordance with this invention wherein a oil or bitumen producing formation is treated to overcome water coning;

FIG. 3 schematically illustrates yet another technique in accordance with this invention wherein an oil or bitumen production well which penetrates an oil or bitumen producing formation underlain by a water producing formation and wherein the water producing formation is treated so that a water impermeable barrier is laid down therein to prevent or deter the movement of water from the water producing formation into the oil of bitumen producing formation during the production of oil of bitumen therefrom;

FIG. 4 graphically shows the relationship of emulsion viscosity to oil cut for a typical Athabasca;

FIG. 5 graphically shows the total bitumen in production samples and bitumen from the water-in-oil emulsions;

FIG. 6 graphically shows the relationship of pressure drop to oil cut;

FIG. *7a*, *7b* schematically show a high pressure flow simulator and associated lead sleeve;

FIGS. 8–15 graphically illustrate data obtained in the operation of the simulator at varying time periods; and FIGS. 16–20 schematically illustrate production well operations in accordance with this invention.

BRIEF DESCRIPTION OF THE INVENTION

It has been discovered that in the production of oil, such as heavy oil or bitumen, from an underground porous formation, particularly from an underground formation which contains and also produces water, there is a minimum temperature Tc for the oil or bitumen and water, such as in the form of an oil-in-water emulsion, for the oil or bitumen to flow, particularly in a partially oil or bitumen depleted porous formation, e.g. greater than about 25% depleted, to move through said formation with the production and/or recovery of oil or bitumen, such as water and oil or bitumen recovery with an oil cut of about 30%, volume or weight, e.g. in the range 25–35% oil cut.

Analysis of the droplet size or diameter of produced oil or bitumen in water emulsions produced from porous underground formations indicate that a significant percentage of the oil or bitumen droplets have diameters greater than the pores of the porous formation. The pore surfaces of the underground porous formation are considered to be water wet but even if the droplets of oil or bitumen therein are larger than the pores, the oil or bitumen droplets can still move through the pores of the formation if the droplets of the oil or bitumen are sufficiently elongated. Droplet elongation is influenced not only by the viscosity of the oil and/or bitumen but also by the pressure gradient involved and droplet surface tension.

The minimum temperature Tc for the water and oil or bitumen, such as in the form of an oil-in-water emulsion, to flow through a porous formation in a porous water and oil or bitumen producing formation, such as in a hot water communication path therein as may be produced in a secondary recovery or hot aqueous flooding operation, as indicated herein, varies with the viscosity of the oil or bitumen, the oil or bitumen droplet surface tension and the pressure gradient to which the droplets or the oil and water emulsion are subjected for movement through the porous formation. Laboratory tests carried out with respect to Athabasca bitumen show that significant bitumen production rather suddenly begins when the production fluid temperature rises to 120° C., considered to be the minimum flow temperature Tc.

In field trials the minimum or critical temperature Tc can also be determined from the production bottom hole temperature of the producing well. Bitumen production therefrom suddenly stops or is very markedly reduced, such as to an insignificant amount, at the bottom hole production temperature of Tc. For example, with respect to the production of Marguerite Lake bitumen production of oil or bitumen drops or substantially ceases or occurs when the production well bottom hole temperature falls to about 100° C. It is of interest to note that the viscosity of Athabasca bitumen at 120° C. is 100 cp, which is the same viscosity as Marguerite Lake bitumen at 100° C.

Various techniques may be employed to reduce the viscosity of the produced oil of bitumen, thereby, in effect, reducing the critical temperature Tc of the produced oil or bitumen and permitting the production of the produced oil or bitumen at a lower bottom hole temperature. For example, the addition of carbon dioxide $CO_2$ or in the presence of carbon dioxide in the produced oil or bitumen during production reduces viscosity. This might be achieved by the introduction of gaseous carbon dioxide into the oil or bitumen producing formation to reduce the critical temperature Tc of the produced oil, such as to lower the bottom hole production temperature Tc of the produced oil or bitumen by as much as 20 degrees Centigrade.

Mention herein has been made of the influence of production pressure gradient upon Tc but the influence of pressure gradient to decrease the critical temperature Tc is not great. However, a higher production pressure gradient does have a favorable influence upon lowering permissible bottom hole temperature or Tc for oil production purposes.

DETAILED DESCRIPTION OF THE INVENTION

Figure 1:
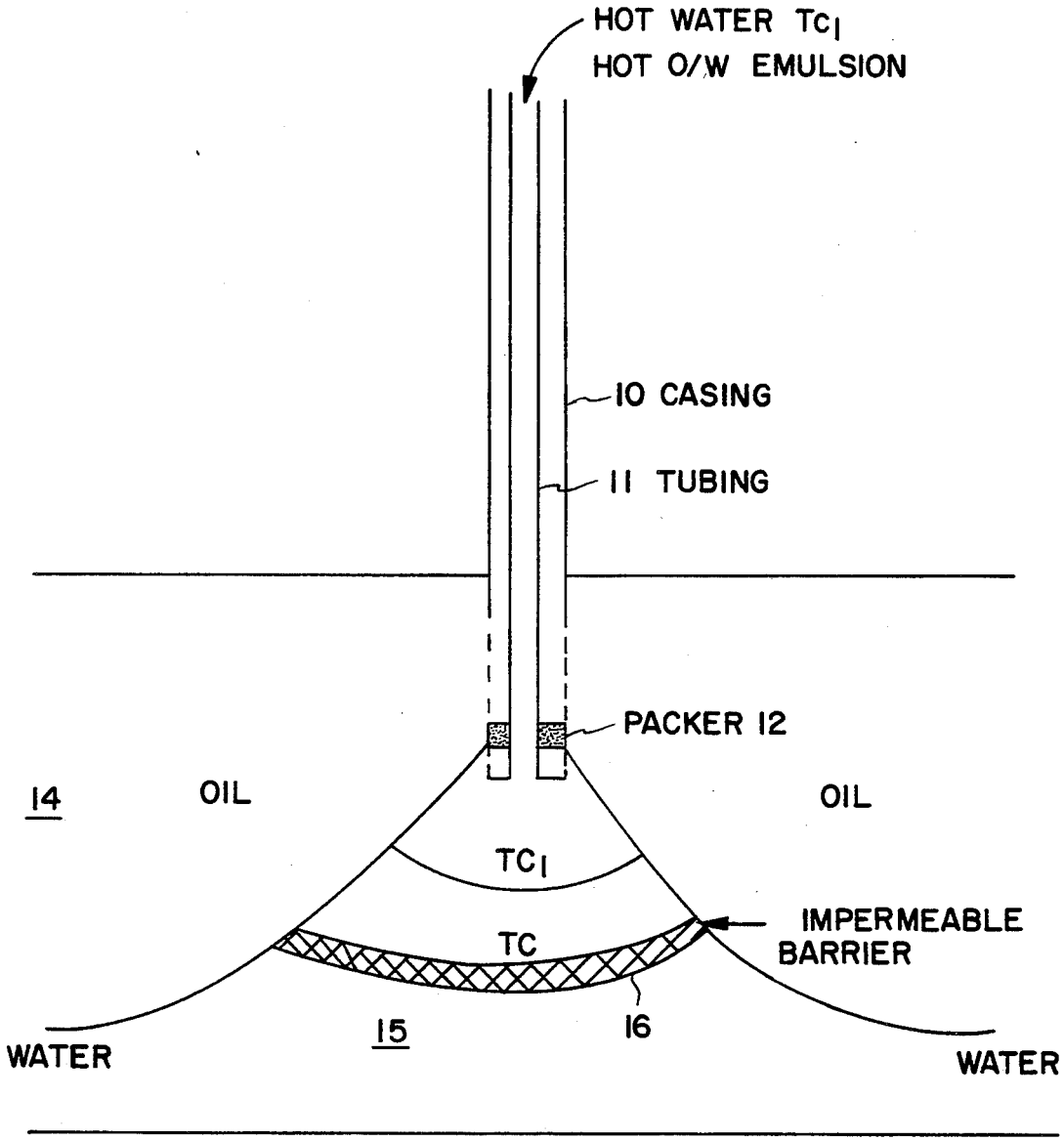

The practice of this invention, particularly for the control and/or modification of the critical production temperature Tc, to insure oil or bitumen production, is generally utilizable to advantage in many petroleum producing operations, not only primary oil or bitumen producing operations but also in secondary and in tertiary oil or bitumen recovery operations, such as in oil or bitumen recovery operations wherein a hot stream of aqueous fluid, steam and/or hot water, is introduced into oil an or bitumen producing formation to drive or move the oil or bitumen therein to a production well for recovery.

The practices of this invention are utilizable in many oil or bitumen producing formations, particularly for the production and recovery of heavy crude or bitumen from formations as are found in locations in the United States, the U.S.S.R., Venezuela and in Canada, particularly in the Province of Alberta. The practices of this invention and the concept of control of production bottom hole temperature or critical oil production temperature Tc to insure the production of water and oil or bitumen from a porous underground formation containing the same, such as operations involving the movement of water and oil or bitumen through an unsaturated porous formation in the form of oil and water mixtures, particularly an oil-in-water emulsions is widely and generally applicable, as indicated.

For example, oil recovery techniques generally employed, such as are disclosed in U.S. Pat. Nos. 3,279,538 (1966), 3,687,197 (1972), 4,271,905 (1981), 4,516,636 (1985) and 4,610,304 (1986), are improved by embodying or employing therein the techniques of this invention involving the control of production bottom hole temperature or critical temperature Tc. Moreover, and additionally, the petroleum or bitumen production techniques disclosed in U.S. Pat. Nos. 4,475,592 (1984), 4,846,275 (1989), 4,884,635 (1989) and 5,056,596 (1991) are especially improved by employing therein the techniques of this invention with respect to the control of production bottom hole temperature or critical temperature Tc. The disclosures and teachings of all the above-identified patents, particularly the co-assigned U.S. Pat. Nos. 4,846,275 and 5,056,596, are herein incorporated and made part of this disclosure.

Following is a description of a special aspect and embodiment of the practices of this invention employed for the prevention and/or elimination of water coning which is often experienced when petroleum (oil or bitumen) is produced from a petroleum producing formation immediately overlaying or in contact with a water producing formation.

Water coning results when oil or bitumen is produced from an oil or bitumen reservoir or formation which contains oil or bitumen having a formation viscosity greater than that of water and which also contains a high water saturation zone, such as a water saturation zone, immediately adjacent or in contact with or below the oil production zone. Relatively high production pressure gradients in the immediate vicinity of the production well overcome the gravity segregation forces and the water level rises, such that the water from the underlying water saturation or production zone eventually breaks through and enters into the oil or bitumen production zone at the production well. When this occurs, water production from the production well drastically increases and oil or bitumen production sharply falls off, eventually making it uneconomical to continue use of the production well for the production of petroleum therefrom.

By employing the practices of this invention, this difficulty, excessive water production accompanied by a small or insignificant amount of oil or bitumen production, is overcome. This indicated problem of water coning is overcome by employing the teachings and discovery of this invention by utilizing a heavy oil or bitumen water emulsion to create an impermeable barrier in the water flow channels at controlled distances from the production well or well bore, see the drawings, particulars FIGS. 1, 2 and 3 thereof. For example, it has been determined, as mentioned hereinabove, that Marguerite Lake bitumen in an oil-in-water emulsion will stop flowing within a porous formation and will form a high oil or bitumen saturation plug therein when the temperature of the oil or bitumen in water emulsion falls below 100° C., the critical production or the bottom hole temperature Tc for this particular bitumen, Marguerite Lake.

Referring now to FIG. 1 of the drawings, hot water at a temperature Tc1 substantially greater than the critical bottom hole temperature Tc is introduced into well casing 10 via tubing 11 past packer 12 into the oil or bitumen producing formation 14 and directly into the water coning or water production zone 15 therein. The water coning zone will have a low oil saturation and will present a relatively high permeability path to the thus-introduced low viscosity hot water. Packer 12 set between the tubing and the casing insures the movement of the hot water into the water coning or water production zone 15. The introduction of hot water into the water production zone 15 via tubing 11 is continued such that the thermal contour Tc1 therein shall have moved some distance, even a small distance of about 2–15 feet from well casing 10 or the point of introduction of the hot water into the formation via tubing 11.

Thereupon, the introduction of the hot water is stopped and hot oil or bitumen in water emulsion is introduced via tubing 11 into the formation substantially immediately following of the introduction of the hot water. The temperature of the introduced oil or bitumen in water emulsion can be the same as or higher than or lower than Tc1 and is preferably at a temperature greater than Tc, the critical bottom hole production temperature for the oil of bitumen in formation 14. The introduction of the oil or bitumen water emulsion is continued and the introduced oil or bitumen in water emulsion advances within the formation and, upon moving through the formation, the temperature of the thus-introduced oil or bitumen emulsion becomes lower or decreases until the advancing front of the thus-introduced oil or bitumen water emulsion reaches or produces the thermal contour Tc, as illustrated. When the thus-introduced oil or bitumen water emulsion reaches the temperature at or just below Tc or crosses the Tc thermal contour, the oil or bitumen water emulsion in effect breaks and forms a high saturation heavy oil or bitumen zone or barrier 16. With respect to a Marguerite Lake oil or bitumen in water emulsion, the bitumen in the thus-created impermeable barrier will have a viscosity of about 10,000 cp when it cools down to a reservoir temperature of 30° C.

It has been indicated hereinabove that the control or lowering of the oil or bitumen in water emulsion Tc can be effected by the incorporation of carbon dioxide therein or by incorporating in the oil or bitumen a minor amount of aromatic hydrocarbons. Accordingly, if it should be desired for reasons of heat economy to reduce the amount of heat introduced into the formation via the hot water and/or the oil-in-water emulsion, the critical temperature of the injected oil-in-water emulsion could be reduced, and as indicated, by incorporating carbon dioxide therein. Also, it is possible to reduce the critical temperature Tc of the introduced oil-in-water emulsion by employing oil in the oil-in-water emulsion which has a viscosity of 1000 cp at a temperature of 30° C. These techniques, such as employing a lower viscosity oil, such as an oil which has a viscosity of 1000 cp at 30° C., would serve to reduce the critical temperature Tc from about 100° C. to about 70° C. Incorporating or adding carbon dioxide thereto would also reduce the critical temperature Tc further, such as by another 20 degrees Centigrade, to a Tc value of 50° C. These techniques when employed would tend to simplify and/or reduce the cost of well treatment in accordance with this invention to prevent and/or eliminate water coning. A high saturation heavy oil barrier 16 formed of oil which has a viscosity of 1000 cp would serve to eliminate water coning.

Figure 2:
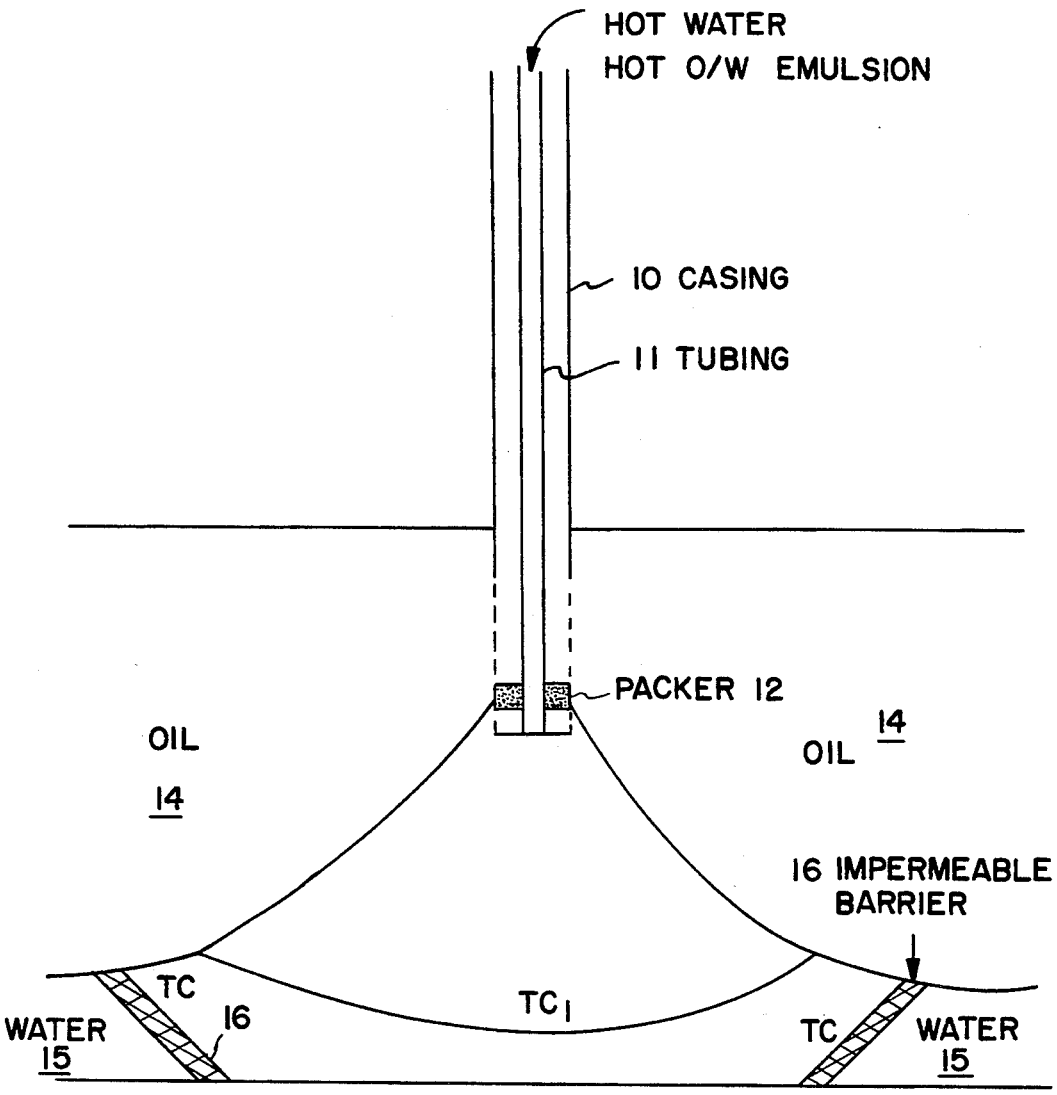

FIG. 2 illustrates another embodiment of the practice in accordance with this invention to overcome water coning similar to that illustrated in FIG. 1. In this embodiment a larger amount of hot water and/or a larger amount of hot oil or bitumen water emulsion is introduced to extend further outward the thermal profiles or contours Tc1 and particularly the thermal contour Tc of the introduced oil or bitumen water emulsion so as to create the impermeable barrier 16 at a greater radial distance from the casing 10 of the production well.

Figure 3:
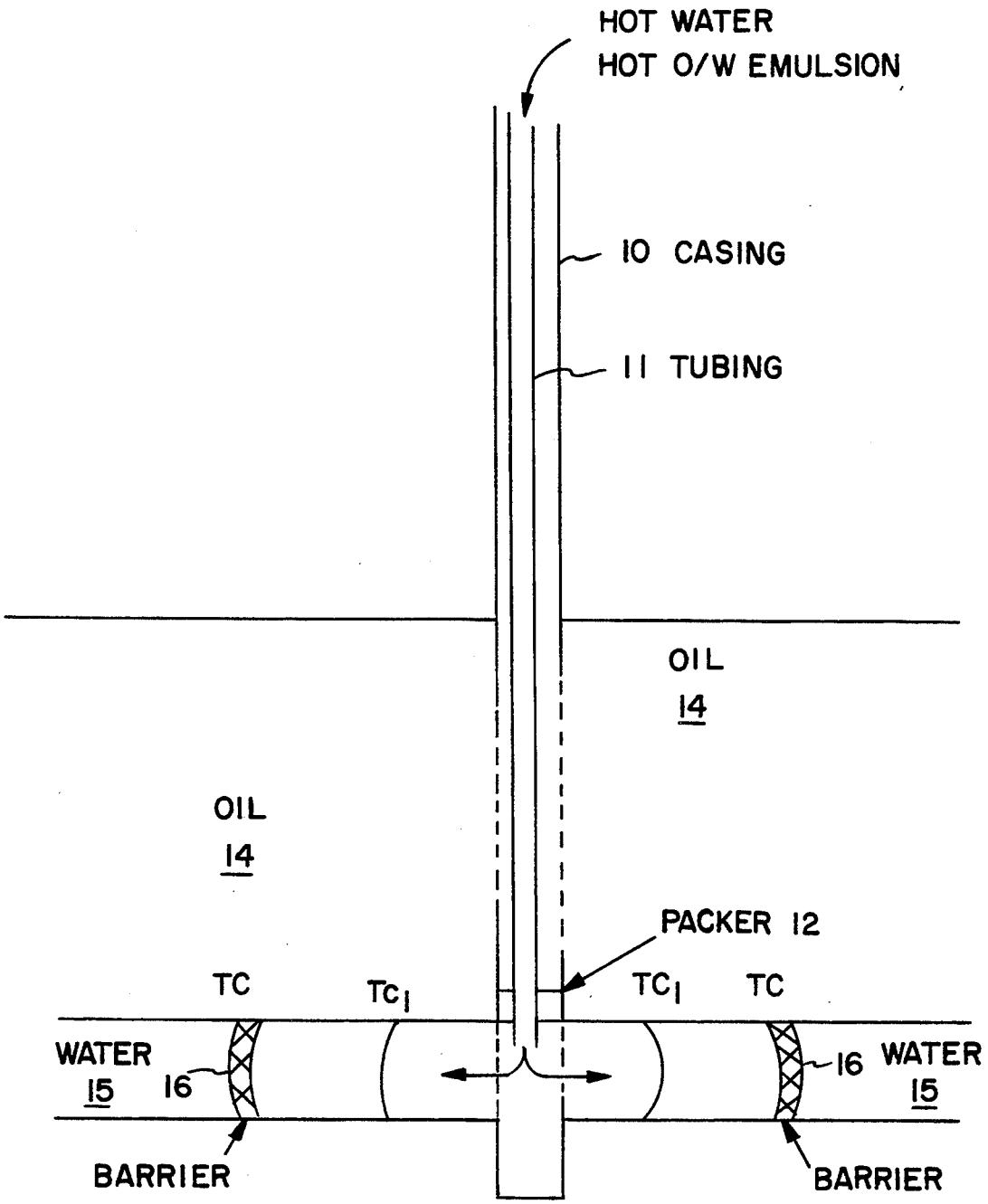

Reference is now made to FIG. 3 of the drawings wherein the same reference numerals have been employed as have been employed in FIGS. 1 and 2 to describe and/or define the same objects and temperatures. More particularly, illustrated in FIG. 3 is a practice in accordance with this invention of creating an impermeable barrier within the underlying water producing formation 15 before the well is brought into production. As illustrated, hot water at the temperature Tc1, desirably followed by hot water or bitumen water emulsion, is introduced into production well defined by casing 10 via concentric tubing 11, past packer 12 at the bottom of casing 10 and tubing 11 into the water producing formation 15. After the introduction of the hot water, hot oil-in-water emulsion is introduced into the water producing formation and moves outwardly therefrom to the temperature or profile contour Tc within the water producing formation 15, the front of the introduced hot oil or bitumen in water emulsion the oil or bitumen in water emulsion can no longer advance and the oil or bitumen plugs the water formation 15 at barrier 16 where the temperature of the introduced oil or bitumen water emulsion reaches the value Tc or slightly lower.

With the creation of the oil or bitumen barrier 16 within the water producing formation 15, the production of oil via casing 10 from the oil producing formation 15 is commenced. The distance of barrier 16 from production casing 10 need not be great because of the large production pressure gradients in the immediate vicinity of the production casing 10 within the oil producing formation 14. The distance between barrier 16 and production casing 10 would depend upon the number of variables, such as the special characteristics of the production zone and, as mentioned hereinabove, the oil viscosity and density and the reservoir vertical and horizontal permeability and the like.

For the last thirty years it has been common knowledge 10 that heavy oil or bitumen production was drastically decreased when a steam zone advanced to a producing well completion zone. This suggests that the low viscosity steam does not always efficiently mobilize the higher viscosity heavy oil or bitumen. On the other hand, existing thermal heavy oil recovery technology is based on field experience in that high temperature steam injection is the best way to recover heavy oil or bitumen. Computer history matching research has not provided full understanding of the bitumen mobilization and transport processes and has failed to define novel recovery processes that would significantly reduce recovery costs and increase total bitumen recovery.

High temperature steam in the range from 300° C. to 350° C. is usually injected in both cyclic and steam flood bitumen recovery operations in order to reduce the viscosity of the bitumen to a level that will allow the bitumen to flow through the reservoir formation. In the first several cycles of cyclic bitumen production the water to oil ratio is 50% or less and stable bitumen flow in the reservoir probably occurs at high temperature as a water-in-oil emulsion in the one meter simulator described in FIG. 7. However, in later cycles the water to oil ratio climbs to 80% or 90% and stable bitumen production continues at much lower bottom hole temperatures than during the first cycles. This is evidence that the bitumen is moving in the reservoir as a single phase oil-in-water emulsion which has a much lower viscosity than the water-in-oil emulsion, see U.S. Pat. No. 4,486,275.

Figure 4:
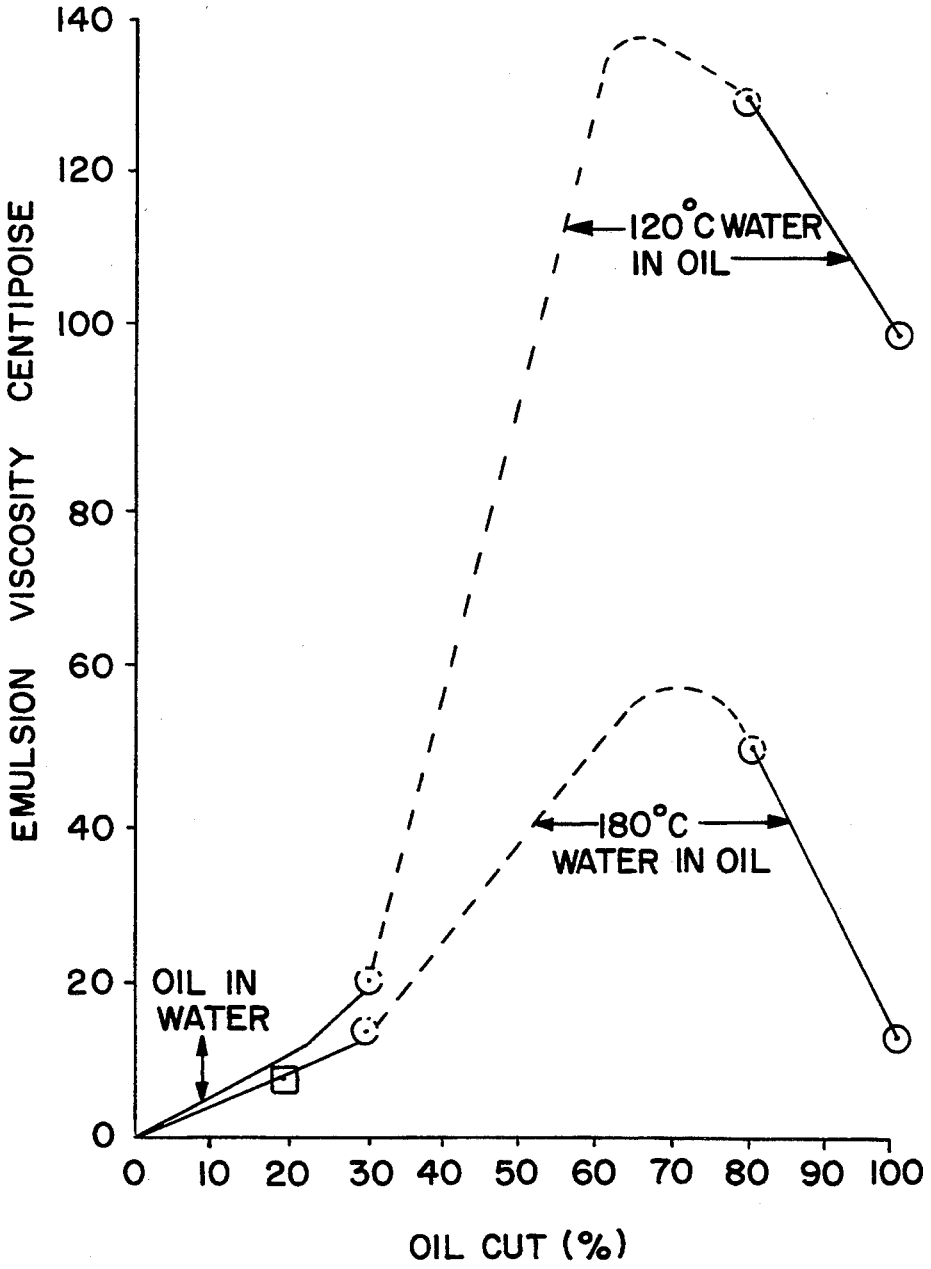

In FIG. 4 there is plotted emulsion viscosity versus oil cut for a typical Athabasca bitumen. At zero oil cut the viscosity is 0.23 centipoise for 120° C. hot water and 0.18 centipoise for 180° C. hot water. The indicted viscosity for 30% oil-in-water emulsion is estimated from laboratory simulator data. Moving to 100% oil cut the viscosities are measured for water free bitumen. As water droplets are entrained the viscosity increases as the oil cut drops to 80%. The dotted lines cover a zone of probably complex mixtures of both types of emulsions. However, at 120° C. the 20% oil cut emulsion has a viscosity of 10 cp while the 80% water-in-oil emulsion has an estimated viscosity of 130 cp. It is difficult to rationalize stable two phase flow of a 130 cp fluid along with 0.23 cp water. Since the produced water to oil ratio at bottom hole temperatures approaching 120° C. is 4 or greater, this difficulty could be resolved if the bitumen moves in the formation as an oil-in-water emulsion.

More conclusive evidence that bitumen is mobilized as an oil-in-water emulsion at relatively low temperature is contained in the paper of T. N. Nasr and A. S. McKay entitled "Novel Oil Recovery Processes Using Caustic and Carbon Dioxide as Dual Additives in Hot Water", paper CIM 15 presented at the Petroleum Society of CIM meeting in Regina, Canada, Sep. 25–26, 1989.

Figure 5:
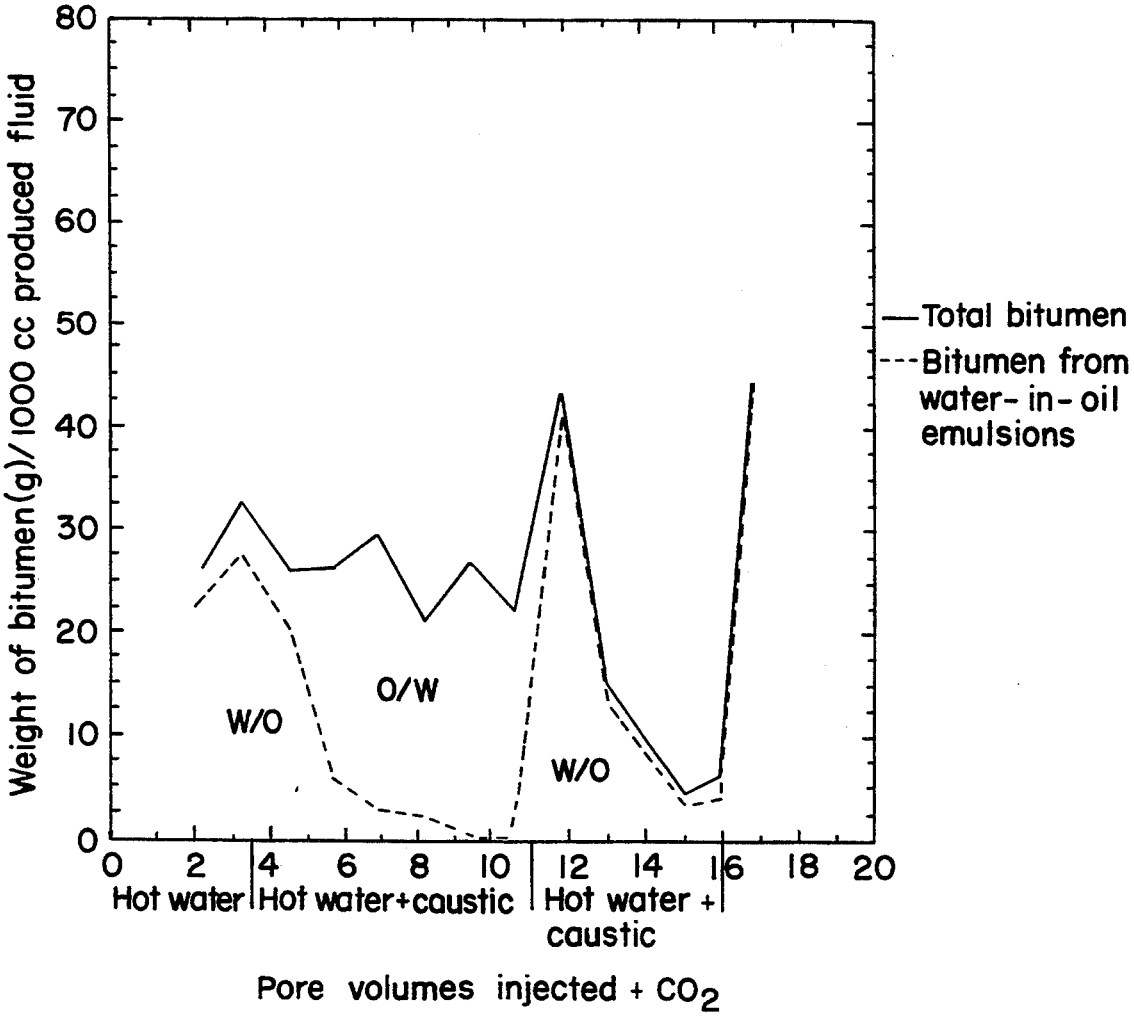

Studies were conducted on Athabasca oil sands in cylindrical cores 31 cm long by 9 cm diameter at 3.6 MPa production pressure and production temperatures as low as 100° C. FIG. 5 shows that the initial bitumen production was mostly as water-oil emulsion when hot water was injected. When caustic was added t 3.5 pore volumes to bring the pH up to 11.5 the produced bitumen was mostly oil-water emulsion. When $CO_2$ was added at 11 pore volumes the produced bitumen quickly reverted to water-oil emulsion. The oil-water emulsion predominates when the produced fluid pH is above 10 and water-oil emulsion is mostly produced when the produced fluid has a neutral or acidic pH. Evidently the bitumen is mobilized and transported in the core as an oil-water emulsion which is unstable when the produced fluid has a pH less than 10 and quickly breaks to form the usual water-oil bitumen production. It is difficult to rationalize a stable two phase flow of hot water with a viscosity of about 0.3 cp and 90% Athabasca bitumen water oil emulsion with a viscosity of around two hundred cp at 100° C.

Figure 6:
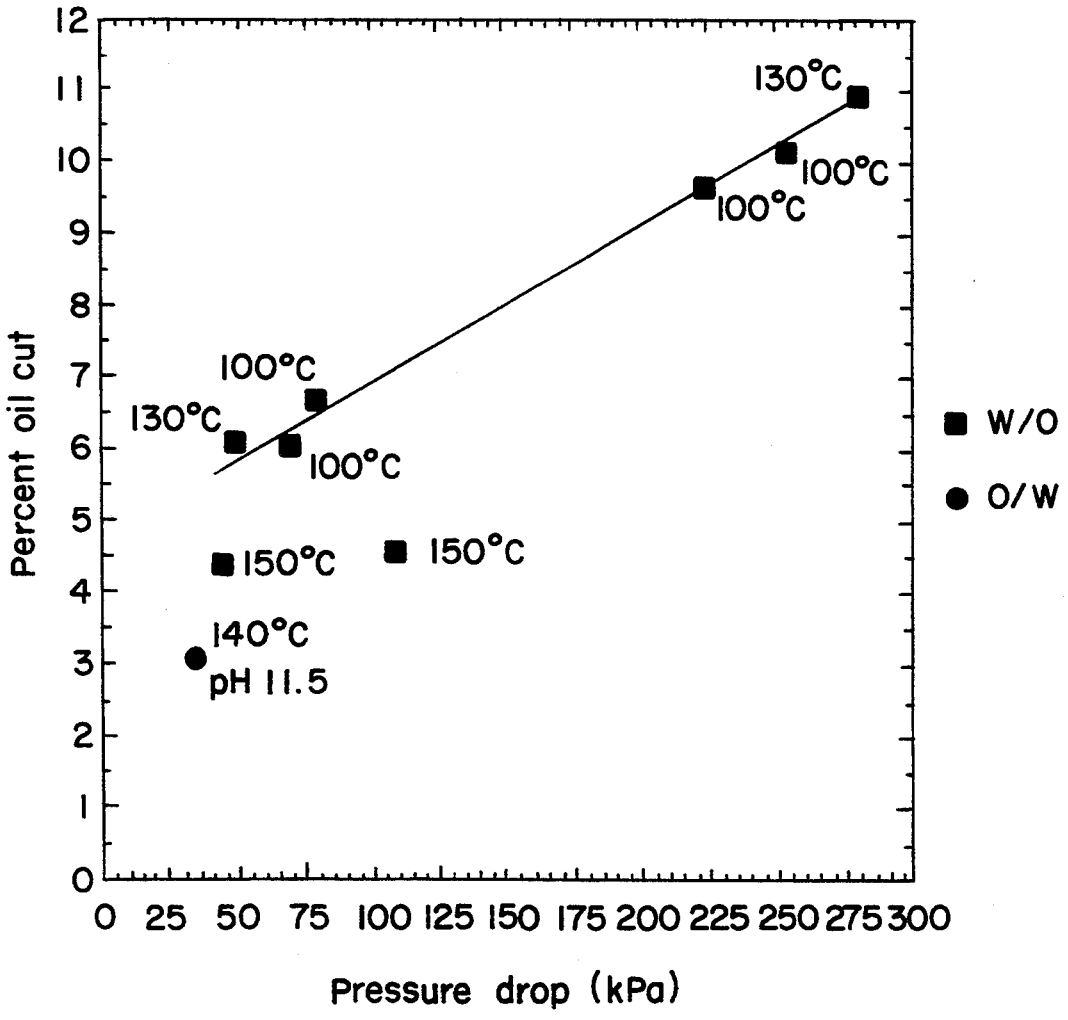

FIG. 6 provides additional data showing that water-oil type production occurred with smaller pressure drops than those for stable oil-water production of equivalent oil cuts. All the water-oil production runs had $CO_2$ injection. The temperatures are produced fluid temperatures. The addition of $CO_2$ has reduced the viscosity of the bitumen and increased the pressure drop and we see a good correlation between produced oil cut and pressure drop when the produced fluid temperature is between 100° C. and 130° C.

It is necessary to introduce the concept of a critical temperature Tc which is the minimum temperature for bitumen in water emulsion to flow in a partially bitumen depleted porous reservoir. Analysis of droplet diameters of produced bitumen in water emulsions indicate that a significant percentage of the droplets have diameters greater than the formation pores. The pore surfaces are considered to be water wet and the larger droplets can still move if sufficiently elongated. The droplet elongation effect is influenced by the bitumen droplet viscosity, the pressure gradient and the droplet surface tension.

Tc is also the minimum temperature for entrainment of the bitumen droplets in moving hot water in a hot water communication path. Laboratory 1 meter simulator work with Athabasca bitumen shows that significant bitumen production rather suddenly begins when the production fluid temperature rises to 120° C. which is considered to be Tc.

In the field Tc can also be determined from the bottom hole temperature when bitumen production suddenly stops while producing a high water to oil ratio. In a Wolf Lake Operation this usually occurs when the bottom hole temperature falls to 100° C., see R. Coates paper entitled "Physical Simulator for Horizontal Well" presented at Western Research Institute and U.S. Department of Energy Tar Sand Symposium held in Vail, Col., Jun. 26–29, 1984. It is of interest to note that the viscosity of Athabasca bitumen at 120° C. is 100 cp which is, the same viscosity as that of Wolf Lake bitumen at 100° C.

Addition of $CO_2$ reduces the viscosity of the bitumen and has reduced Tc by as much as 20° C. in the laboratory and in the field. Control of droplet surface tension with surfactants or caustic in order to reduce Tc has not been systematically investigated.

However, the laboratory data presented in reference No. 6 indicates that injection of 0.1% synthetic crude with hot water is very effective in lowering the Tc of Athabasca bitumen and also gives significantly higher bitumen recovery. It is noted that the hot water and aromatic hydrocarbon mixture should be injected at a temperature at least above 80° C. This is considerably below the Tc of 120° C. for Athabasca bitumen when hot water or stem is injected without additives.

The influence of the pressure gradient Tc is not strong although Tc does decrease as the pressure gradient increases.

Figure 7A:
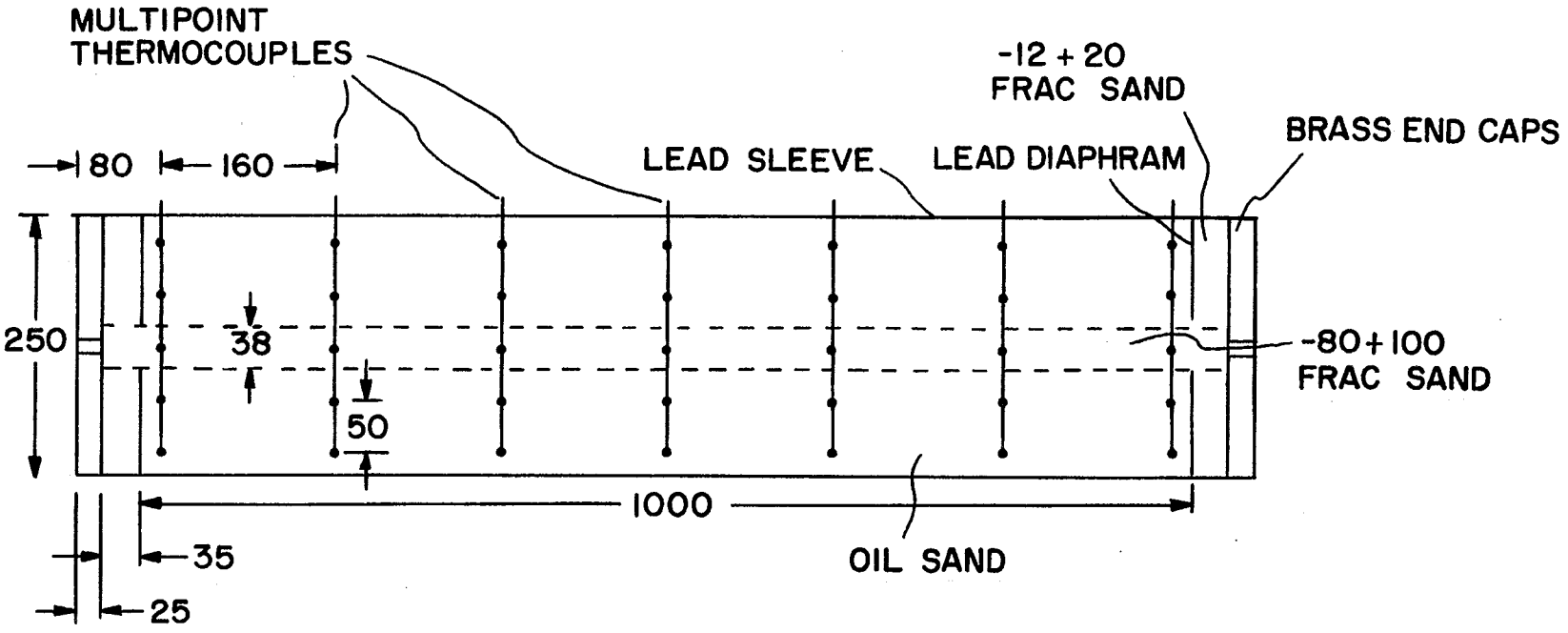
Figure 7B:
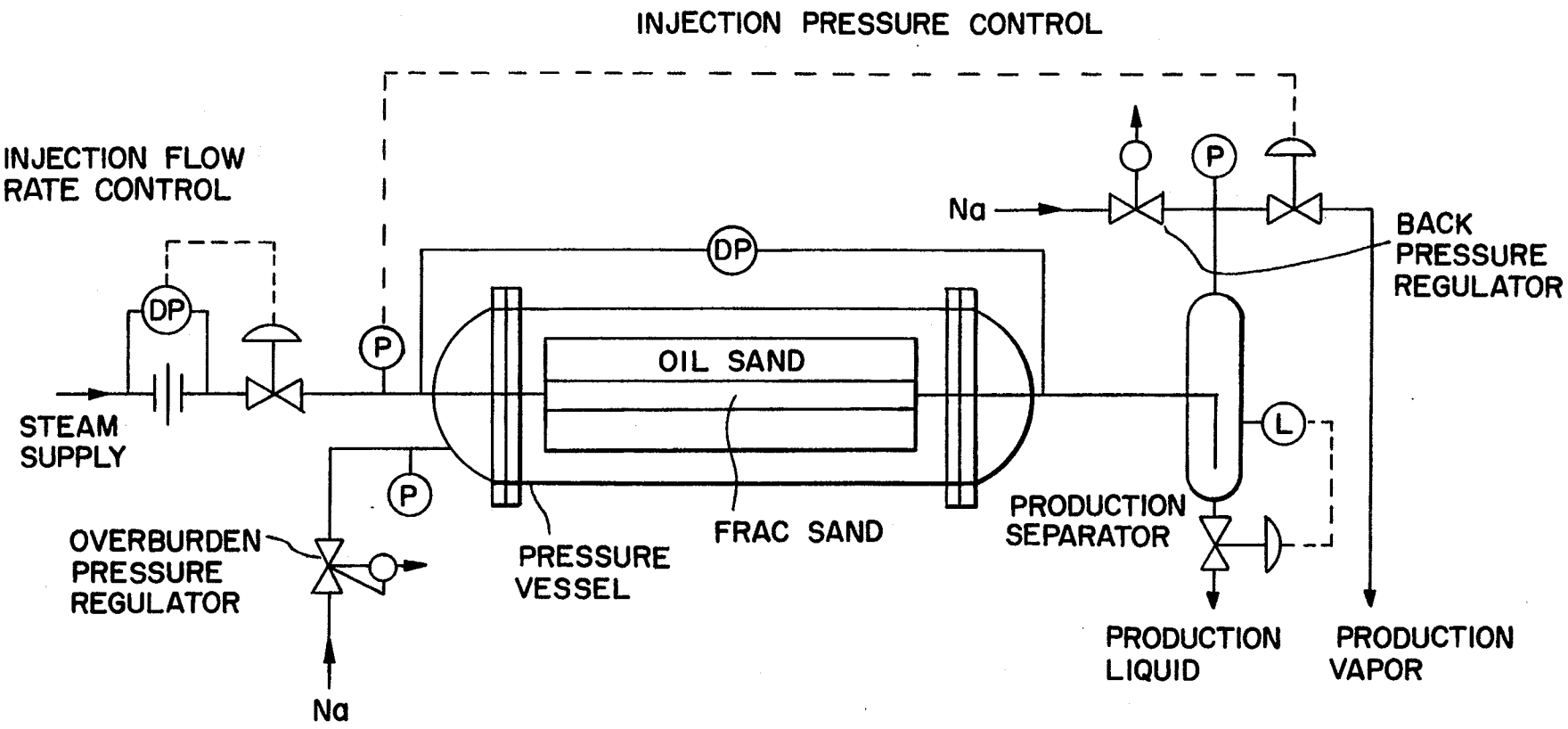

A run was made in the one meter simulator described in FIG. 7 by injecting 80% quality steam at a relatively low temperature of 200° C. and resulted in good bitumen recovery with a produced oil cut of around 20% for much of the production. Conventional analysis concludes that the injected steam was very effective in mobilizing and moving the bitumen in the producing end of the simulator.

Many critical parameters, such as injection and production fluid temperatures and pressures and steam and water injection rates, were recorded every five minutes. Also, the temperatures of thirty-five thermocouples imbedded in the simulator were recorded every five minutes. The seven thermocouples in the frac sand communication path proved to be very helpful in developing a better understanding of this particular steam run. The produced fluid data analysis was made over timed intervals that varied from 15 to 20 minutes. Data were extracted and thermal profiles were plotted at key times in the run as will be presented and discussed in chronological order.

1) 120 Minutes

TABLE 1

| | |
|---|---|
| Injection P 232.29 psi | Production P 230 psi |
| Injection T 205.38° C. | Production T 73.41° C. |
| ΔP across simulator = 2.2 psi | |

THERMOCOUPLE TEMPERATURES

TABLE 1-continued

| | | 0.3 etc. | 0.4 etc. |
|---|---|---|---|
| 0.2 | 85.3° C. | 168.7° C. | 95.1° C. |
| 1.2 | 84.1 | 150.3 | 76.8° C. |
| 3.2 | 77.9 | 112.4 | 60.7° C. |
| 4.2 | 61.0 | 111.0 | 56.7° C. |
| 5.2 | 59.0 | 97.7 | 51.3° C. |
| 6.2 | 53.3 | 90.7 | 54.3° C. |
| | Below | Communication Path | Above |

Note:
The 2.1, 2.2, 2.3, 2.4 and 2.5 thermocouple temperatures are not consistent and will not be used until 295 minutes.

Figure 8:
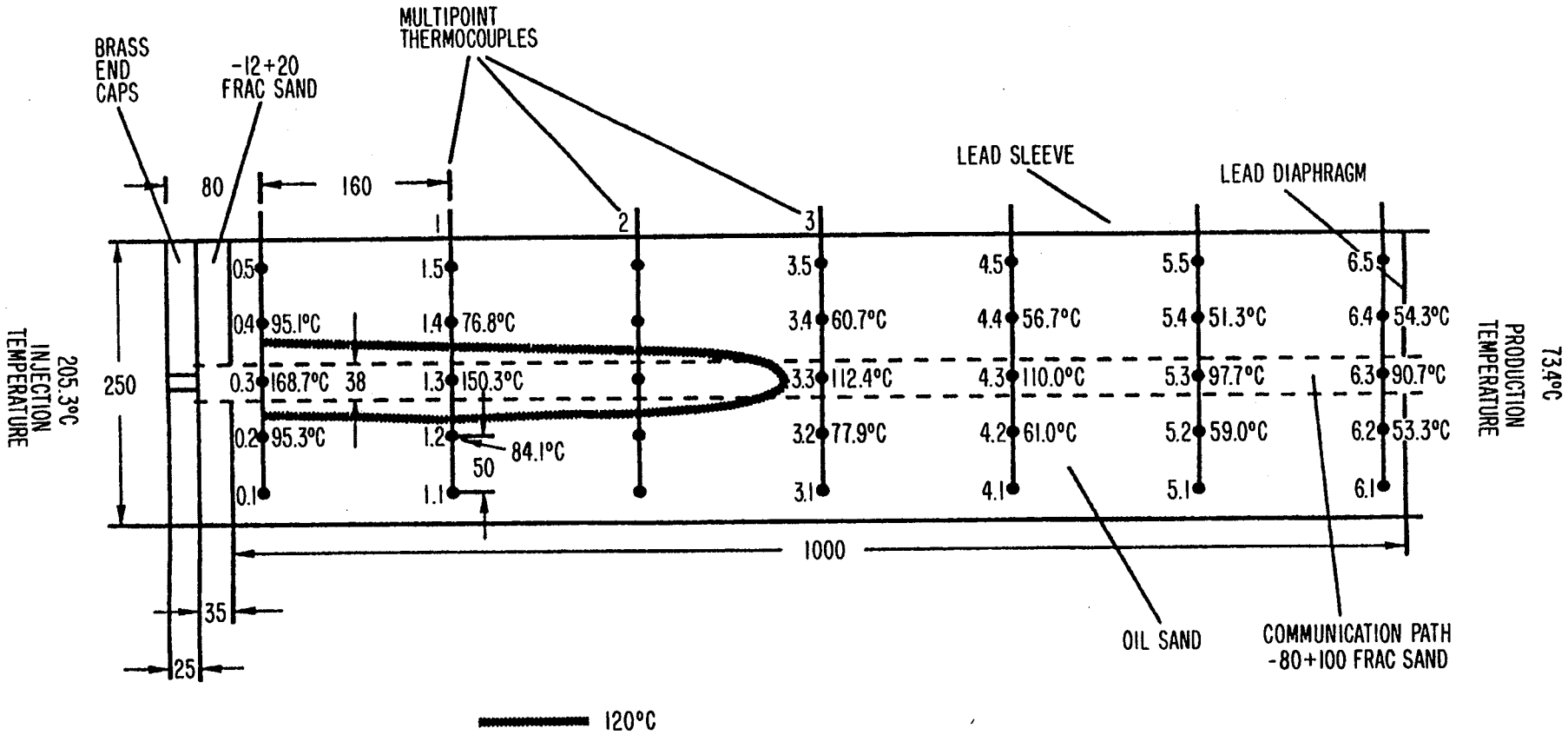

The 120° C. temperature profile is plotted in FIG. 8 with the thermocouples identified by number and the temperatures given in °C. At this point no bitumen has been produced and very little tar sand lies within the 120° C. profile since the dotted lines represent the frac sand communication path. The ΔP across the simulator decreases as the room temperature water in the communication path is displaced by higher temperature lower viscosity water and there is no indication of communication path plugging. However, the hot water injection should have continued until the producing end of the path reached 120° C. to provide a reliable path for bitumen in water emulsion since the ΔP increased to 183 psi when steam was injected. This came very close to plugging the communication path. It is almost certain that injection of steam at the same rate without the preliminary injection of hot water would have plugged the communication path with cool bitumen.

2) 140 Minutes

200° C. 80% quality steam has been injected for 15 minutes at 5 kg/jr. At 142 minutes only 1.8 grams of bitumen has been produced but over the next 15 minutes the oil cut averages 20.4% bitumen. There is a critical point in time when all the conditions necessary for the mobilization and transport of bitumen are satisfied for the first time in the run.

TABLE 2

| | |
|---|---|
| Injection P 191.1 psi | Production P 6.0 psi |
| Injection T 201.3° C./ | Production T 109.3° C. |
| Steam Sat. 217 psi | Steam SVP 6.0 psi |
| Vapor P | |
| ΔP = 183 psi | |

| | Communication Path Temperatures and Saturated Steam Pressures | |
|---|---|---|
| | Temp. | Sat Stem Pressure |
| 0.3 | 195.5° C. | 190 psi |
| 1.3 | 192.6 | 178 |
| 3.3 | 181.5 | 136 |
| 4.3 | 179.5 | 129 |
| 5.3 | 169.4 | 99 |
| 6.3 | 152.2 | 58 |

Evidently the communication path temperatures can be converted to plausible pressures as long as at least a small amount of steam is present. In this case it appears that some steam is still present at thermocouple 6.3 at a temperature of 152° C. It is observed that the produced fluid temperature can be much lower than the temperatures within the simulator.

Figure 9:
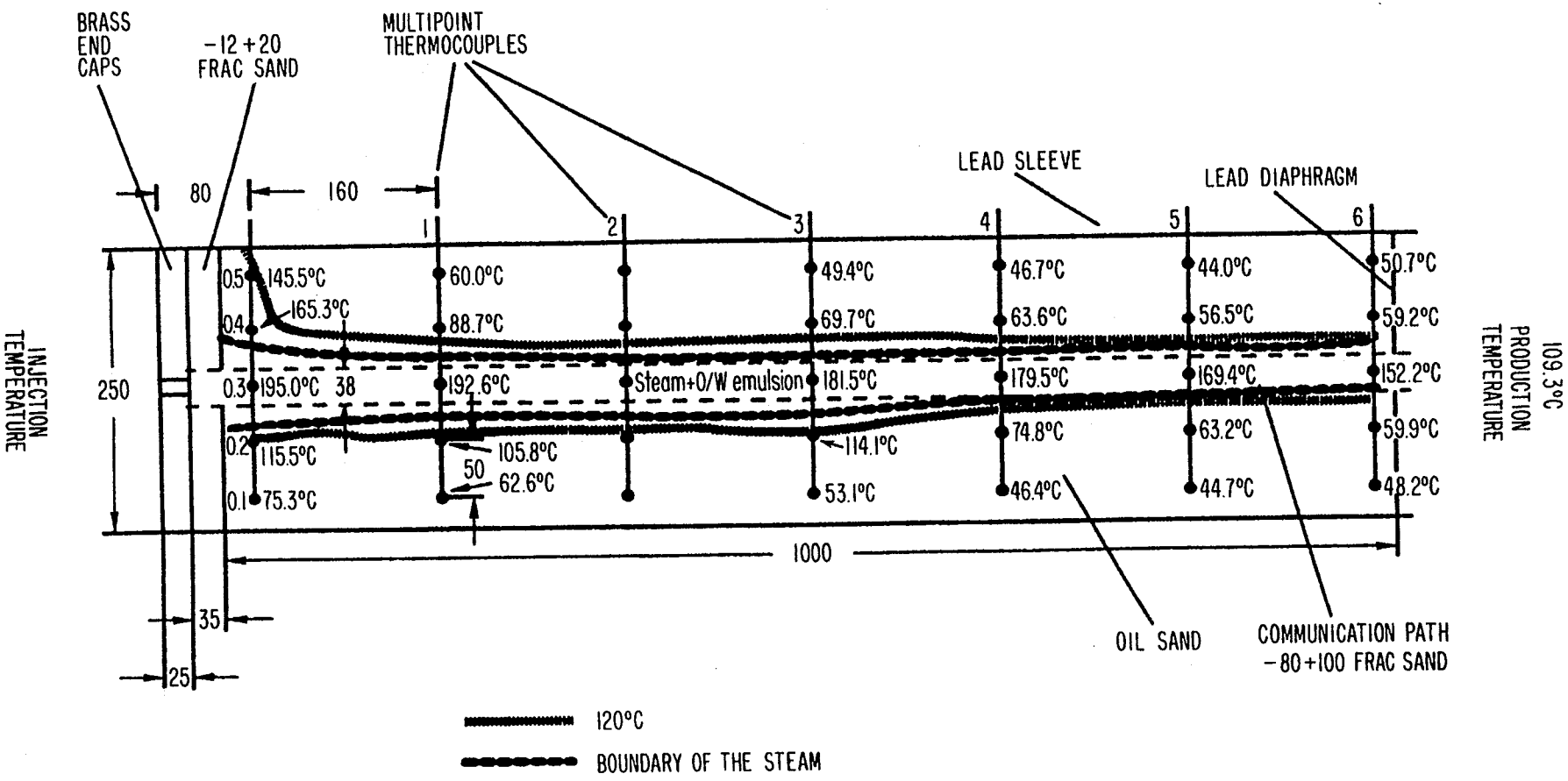

In FIG. 9 there are plotted both the steam and the 120° C. thermal profiles. The 120° C. profile is considered to be the approximate bitumen mobilization boundary. There is already indication of upward thermal movement at the injection end of the simulator. At this stage, the steam is mostly confined to the high permeability communication path and the flowing fluid consists of O/W plus a decreasing amount of steam as it approaches the production end of the cell.

3) 200 Minutes

TABLE 3

| | |
|---|---|
| Injection P 192.6 psi | Production P 108.2 psi |
| Injection T 200.0° C. | Production T 170.4° C. |
| Injection Sat 215 psi | Production SSVP 101 psi |
| Steam VP | |
| ΔP = 84.4 psi | |

| Temp. °C. | 0.2's °C. | Temp. 0.3's °C. | Temp. Steam SVP | 0.4's °C. | Temp. 0.5's °C. | Temp. |
|---|---|---|---|---|---|---|
| 0.1 | 133.9 | 176.3 | 195.3 | 190 psi | 195.1 | 195.0 |
| 1.1 | 93.1 | 138.6 | 193.2 | 181 | 128 | 96.3 |
| 3.1 | 88.6 | 156.7 | 187.6 | 159 | 119.2 | 81.0 |
| 4.1 | 79.0 | 122.5 | 185.2 | 150 | 167.2 | 84.7 |
| 5.1 | 70.6 | 107.0 | 181.7 | 137 | 92.2 | 68.7 |
| 6.1 | 70.7 | 94.3 | 177.4 | 123 psi | 98.5 | 78.6 |

It is noted that the injection saturated steam vapor pressure is greater than the injection pressure while the reverse condition exists at the production end. These conditions are maintained throughout all runs. Thermocouple temperatures excluding the 2 bank plus the corresponding steam saturated vapor pressure along the communication channel are given.

The production fluid steam SVP is 101 psi while the actual production pressure is 108.2 psi. However, the pseudo pressure drop from point 6.3 to the production pressure is −15 psi. As long as some steam is present the measured temperature should determine the pressure. The pressure gradient along the communication path gradually increases as the fluid oil cut increases past 4.3 and it appears that traces of steam persist to the 6.3 thermocouple under the operating conditions of this run.

Figure 10:
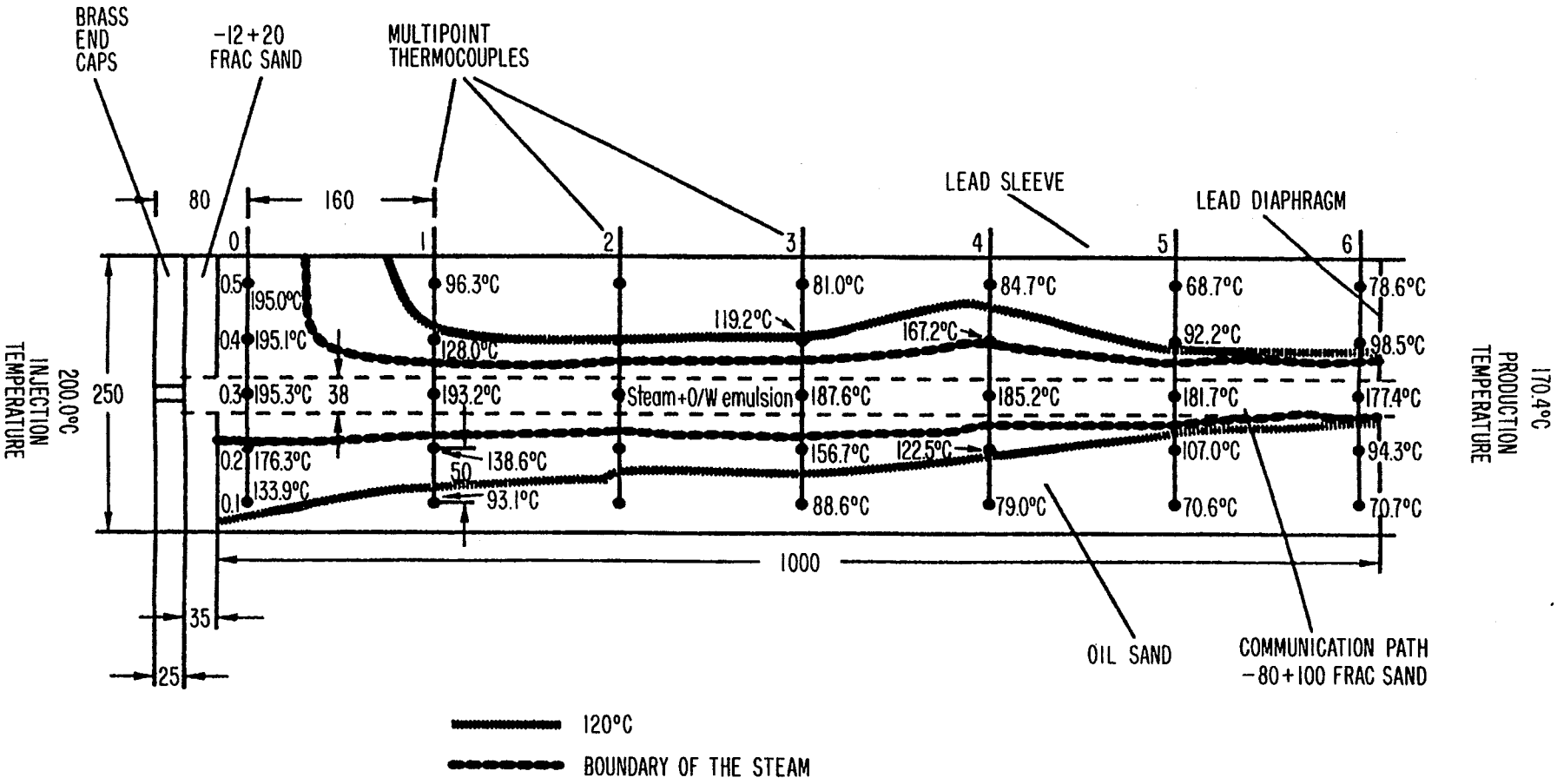

From FIG. 10 it is seen that the steam has already move dup to the top of the simulator at the injection end. Apparently gravity favors the upward movement of the steam. This provided a much more effective bitumen recovery process than one where the steam would be initially confined to the immediate vicinity of the communication channel.

No steam exists outside the steam contour but bitumen mobilization and movement of an O/W emulsion takes place in the volume between the steam contour and the 120° C. contour. The 120° C. contour moves faster and encloses a much greater volume of tar sand than does the steam contour. This hot water component is a very important factor in so called steam bitumen recovery processes.

4) 260 Minutes

TABLE 4

| | |
|---|---|
| Injection P 209.3 psi | Production P 111.8 psi |
| Injection T 203.9° C. | Production T 169.9° C. |
| Injection SSV 228 psi | Production SSVP 99 psi |
| ΔP - 97.5 psi | |

| Temp. °C. | 0.2 °C. | Temp. 0.3's °C. | Temp. SVP psi | Steam 0.4's °C. | Temp. 0.5's °C. | Temp. |
|---|---|---|---|---|---|---|
| 0.1 | 164.0 | 197.7 | 199.0 | 206 | 198.9 | 198.8 |
| 1.1 | 127.8 | 158.3 | 197.8 | 200 | 197.7 | 197.7 |
| 3.1 | 110.8 | 165.7 | 192.5 | 178 | 138.7 | 139.6 |
| 4.1 | 103.1 | 133.9 | 191.6 | 173 | 184.4 | 121.7 |
| 5.1 | 94.3 | 122.4 | 188.9 | 162 | 125.0 | 97.1 |
| 6.1 | 96.5 | 99.5 | 183.5 | 143 | 103.7 | 91.3 |

Figure 11:
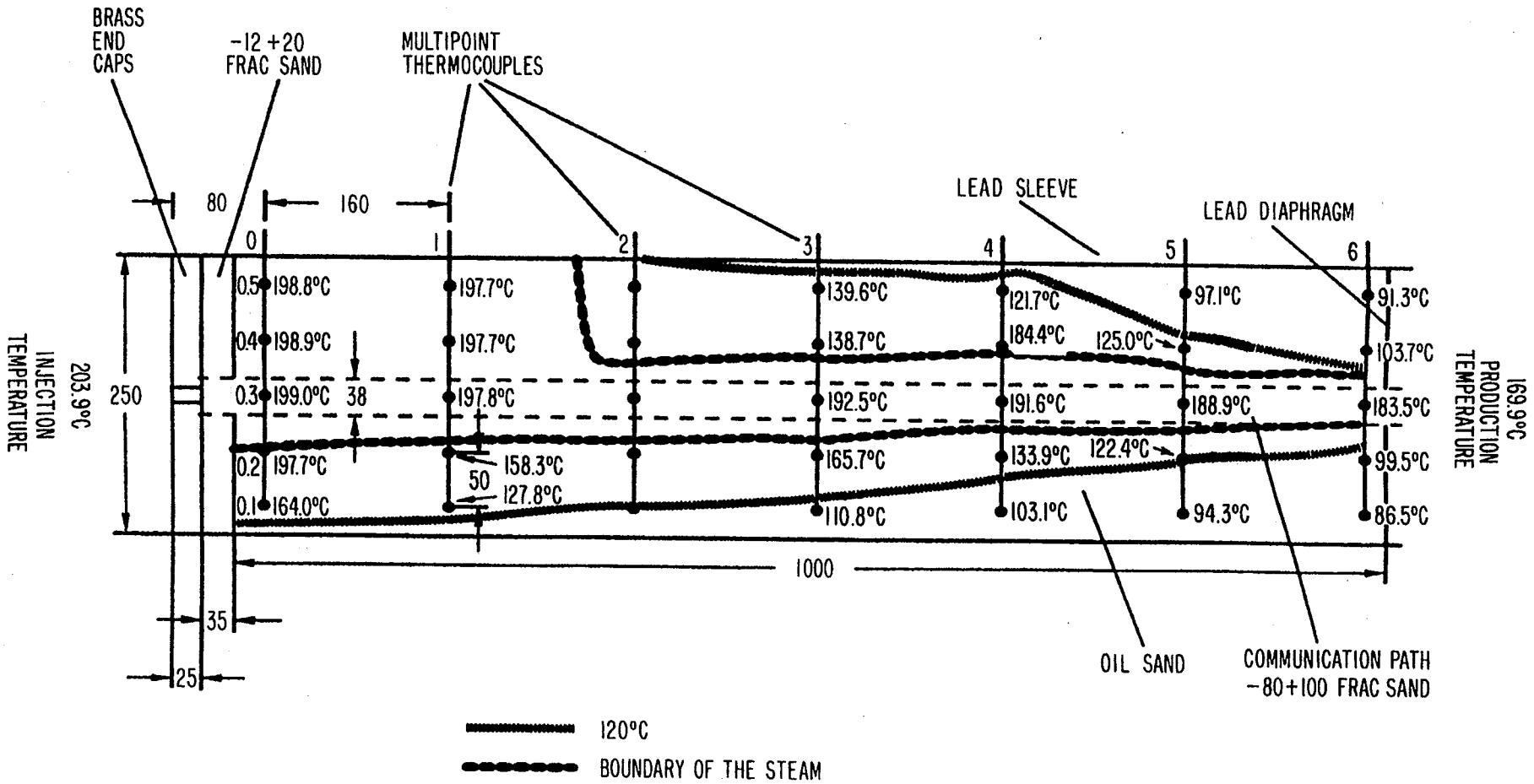

The highest oil cut of 26.3% bitumen was obtained during the interval from 252 to 268 minutes. A comparison of FIG. 10 with FIG. 11 shows that the upper 120° C. profile has moved upwards five or six centimeters and has also moved horizontally about 24 centimeters. The lower 120° C. profile has only moved downwards about 1.5 centimeters.

5) 295 Minutes

TABLE 5

| Injection P 160.8 psi<br>Injection T 189.7° C.<br>Injection SSV 165 psi<br>ΔP - 76.5 psi | | Production P 84.3 psi<br>Production T 158.5° C.<br>Production SSV 72 psi | | | |
|---|---|---|---|---|---|
| Temp. °C. | 0.2's °C. | Temp. 0.3's °C. | Temp. 0.4's °C. | Temp. 0.5's °C. | Temp. |
| 0.1 | 163.0 | 184.3 | 187.4 | 187.3 | 187.2 |
| 1.1 | 146.3 | 165.6 | 186.6 | 186.5 | 186.4 |
| 2.1 | 121.3 | 160.9 | 188.8 | 166.7 | 181.7 |
| 3.1 | 121.4 | 161.0 | 182.0 | 166.0 | 181.8 |
| 4.1 | 112.6 | 139.4 | 182.4 | 145.0 | 122.2 |
| 5.1 | 102.6 | 125.6 | 179.8 | 129.5 | 108.5 |
| 6.1 | 88.9 | 97.7 | 172.8 | 104.1 | 94.5 |

Figure 12:
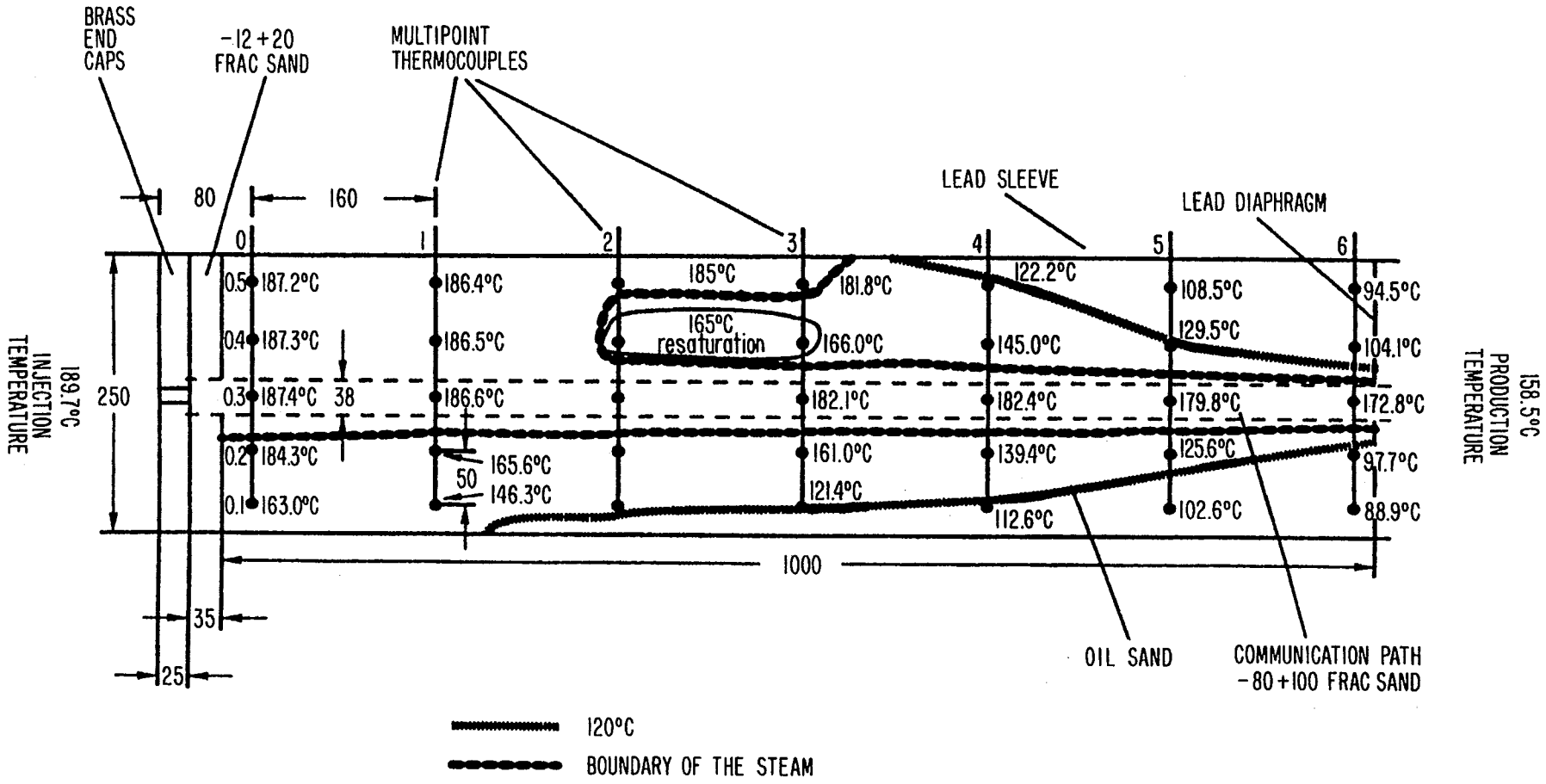

The produced oil cut from 252 to 268 minutes was 26.3% and then dropped to 21.8% from 268 to 288 minutes and to 19.3% from 288 to 306 minutes. The 2's thermocouple bank data was not used previously because it was one or two degrees higher than the 1's and 3's temperatures. However, at 275 minutes the 2.4 thermocouple began to register a significantly lower temperature than the 2.5 thermocouple and by 295 minutes the 3.4 thermocouple was also reading 15° C. lower than 3.5 as indicated in the above table. This data has been included in FIG. 12 and continues to carry on into FIG. 13. A comparison of FIG. 10 with FIG. 11 indicates that most of the bitumen mobilization was taking place in the upper volume of the simulator when the 26.3% oil cut was produced and that a lower oil cut was probably being produced from the lower portion of the simulator. It is possible that the upper portion was yielding an oil cut above 30% and the resulting emulsion would have a higher viscosity and could terminate fluid movement at formation temperatures in the range from 150° C. to 170° C. (see FIG. 4). This concept presents an explanation for the unexpected thermal data which persisted for almost an hour and can also explain the sudden development of steam override.

6) 320 Minutes

TABLE 6

| Injection P 159.2 psi<br>Injection T 189.3° C.<br>Injection SSVP 165 psi<br>ΔP - 87.8 psi | | Production P 17.4 psi<br>Production T 153.1° C.<br>Production SSVP 60 psi | | | |
|---|---|---|---|---|---|
| Temp. °C. | 0.2's °C. | Temp. 0.3's °C. | Temp. 0.4's °C. | Temp. 0.5's °C. | Temp. |
| 0.1 | 156.7 | 185.0 | 186.7 | 186.7 | 186.7 |
| 1.1 | 151.2 | 167.2 | 185.8 | 185.7 | 185.7 |
| 2.1 | 124.4 | 154.9 | 188.2 | 173.7 | 180.5 |
| 3.1 | 124.5 | 154.9 | 182.7 | 173.4 | 180.7 |
| 4.1 | 117.4 | 139.9 | 180.8 | 150.6 | 164.7 |
| 5.1 | 107.3 | 128.6 | 177.5 | 127.4 | 111.8 |
| 6.1 | 90.2 | 98.4 | 170.5 | 102.7 | 96.4 |

Figure 13:
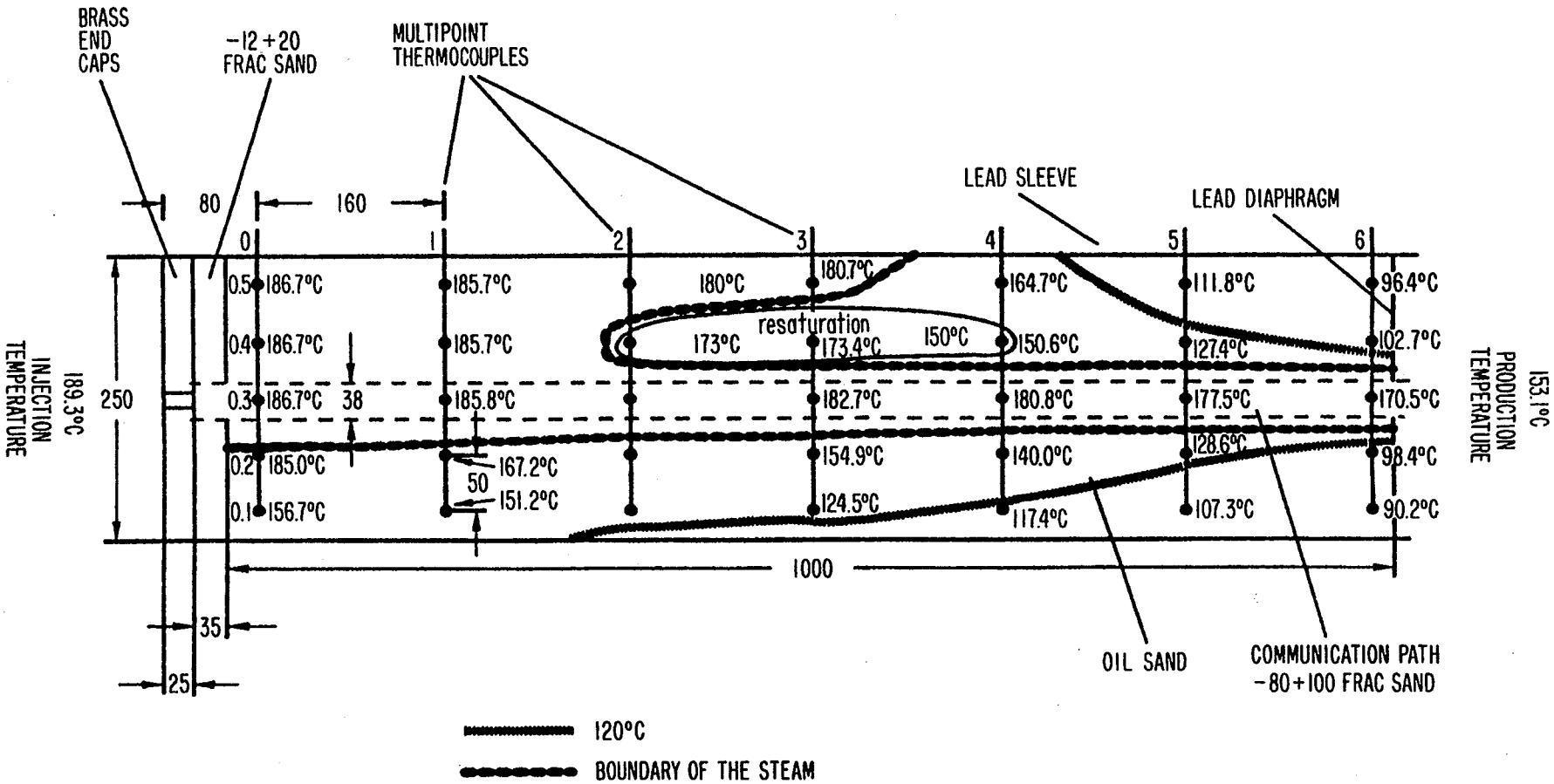

Looking at FIG. 13 it is noted that the resaturation plug now extends to thermcouple 4.4. However, the front end at 2.4 has warmed up to 173° C. and with 180° C. zones on both top and bottom of the narrow plug it seems to be on the verge of disintegrating.

7) 360 Minutes

Figure 14:
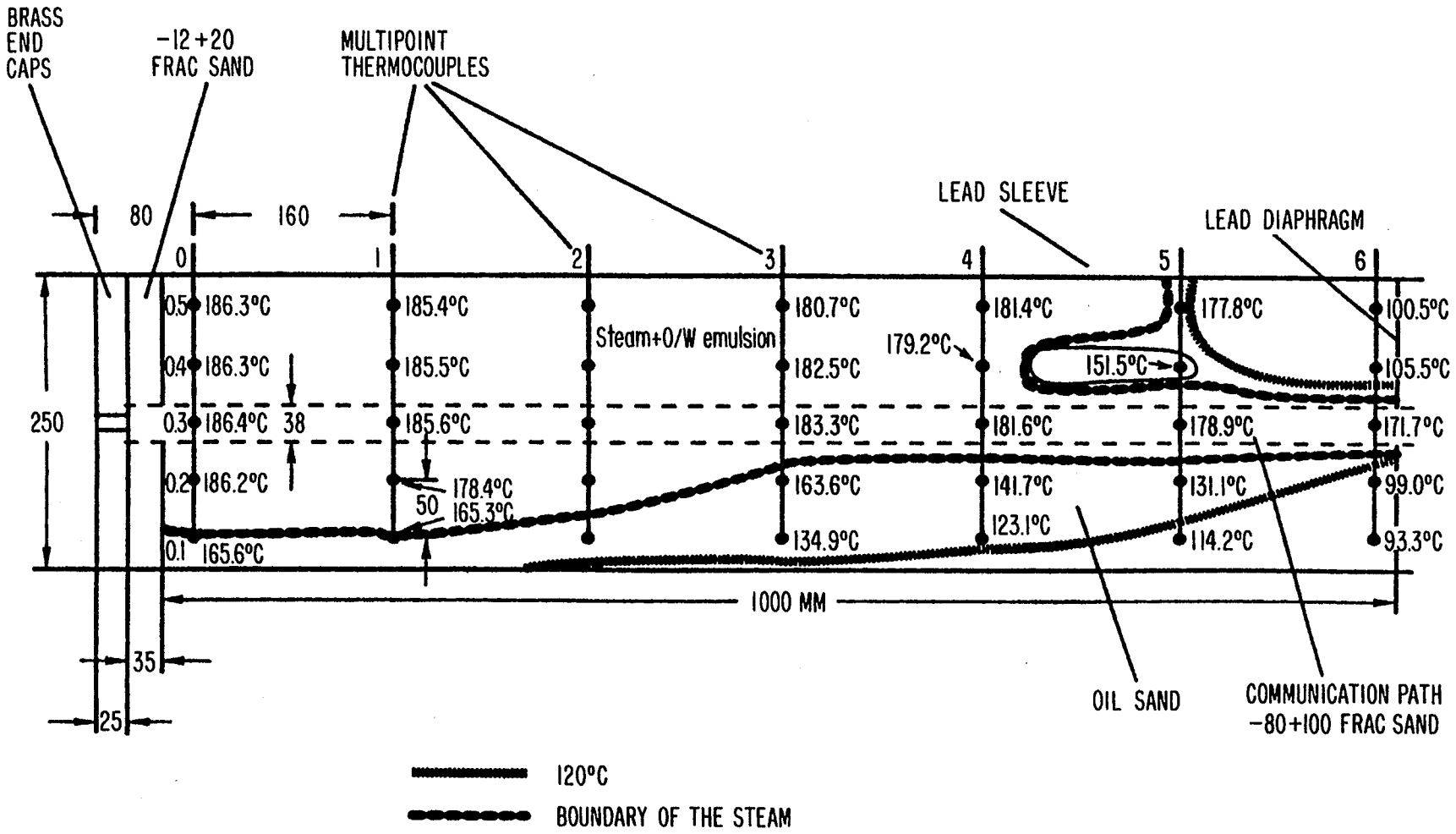

In FIG. 14 it is observed that the plugged zone has moved ahead to 5.4 and is much shorter. There is also a significant downward movement of the steam profile for the first time. This is probably because the bitumen saturation had been reduced by the prior hot water bitumen mobilization in the lower portion of the simulator.

8) 395 Minutes

Figure 15:
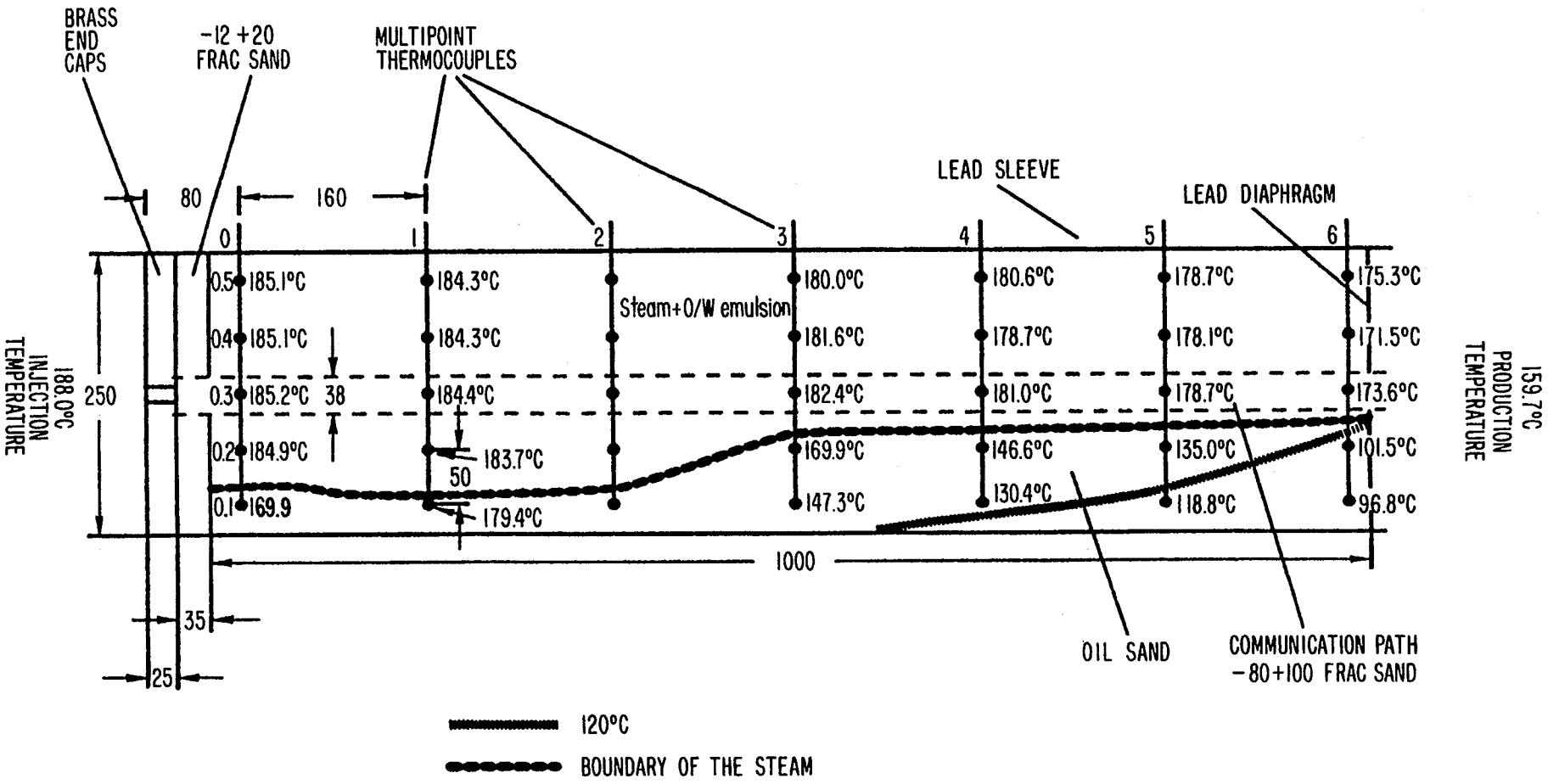

In FIG. 15 the upper zone is now entirely at saturated steam temperatures and the 120° C. contour is almost gone in the lower zone although there is still a large hot water volume between the steam contour and the 120° C. contour. At this point approximately 40% of the oil in place has been recovered and the study was terminated. Steam continued to be injected to 2285 minutes and the ultimate recovery was about 62% of the oil in place.

The vertical temperatures in the steam zone seem to have greater variations in the production end than at the injection end of the simulator. This could be due to lower steam quality and higher formation bitumen saturation at the production end. It could also be partly due to thermocouple calibration since the variations will be made. Steam injection was interrupted from 395 minutes until 410 minutes and the requested data print out terminated at 415 minutes.

In these tests there were created bitumen in water emulsion from Athabasca tar sand and moved the emulsion through porous material while recording relevant temperatures and pressures. The produced oil cut was around 20%. This data can be used to estimate the viscosity of the 20% oil cut emulsion under reservoir conditions. This measurement should be more realistic than measuring the viscosity of bitumen in water emulsions in a viscosimeter in the laboratory.

At 5 minutes of hot water injection, the ΔP across the cell was 12.0 psi. At this time the communication path contained mostly 20° C. water with a viscosity of 1 cp. At 120 minutes of 200° C. hot water injection, the ΔP across the cell was 2.24 and the average viscosity of the hot water in the communication path was $$\frac{2.24\ \text{psi}}{12.0\ \text{psi}} \times 1\ \text{cp} - 0.19\ \text{cp}$$

which is the viscosity of 140° C. water.

This method of estimating the viscosity of the communication path fluid will now be used to estimate the viscosity of the bitumen in water emulsion. At 140 minutes very little bitumen has been produced, but from 142 to 157 minutes the average produced oil cut is 20% and at 140 minutes there must be bitumen in water emulsion in the communication path. Since the ΔP across the cell is 183 psi, we estimate that the flowing bitumen in water emulsion which also contains some steam has an average viscosity of $$\frac{183\ \text{psi}}{12.0\ \text{psi}} \times 1\ \text{cp} = 15\ \text{cp}.$$

However, the production fluid temperature was 109.3° C. which was lower than the Tc temperature of 120° C. and the ΔP between thermocouple 6.3 and the production pressure was 52 psi. This indicates that the viscosity of the emulsion at the production end is considerably greater than 15 cp and the emulsion above Tc has a viscosity less than 15 cp.

At 200 minutes the entire communication path is well above Tc and we are still producing a 20% oil cut fluid with a ΔP of 84.4 psi. This gives an estimate for the emulsion viscosity of $$\frac{84.4\ \text{psi}}{12} \times 1\ \text{cp} = 7\ \text{cp}.$$

The ΔP between thermocouple 6.3 and the production pressure is 15 psi. This compares with a ΔP of 52 psi at 140 minutes and the apparent viscosity of the emulsion below Tc at the production end is $$\frac{52\ \text{psi}}{15\ \text{psi}} \times 7\ \text{cp} = 24\ \text{cp}$$

The viscosity of 7 cp for a 20% bitumen in water emulsion when the communication path is entirely above Tc is a realistic value for field applications.

By way of summary, an interpretation technique has been used to interpret the one meter simulator data bank. Wherever steam is present the thermocouple temperature can be converted to the saturated steam vapor pressure which is also the same as the fluid pressure regardless of the amount or quality of the steam.

The basic linear pressure gradient was generated in the frac sand communication path throughout the run and the fluid pressures calculated from the thermocouple temperatures gave credible pressure drops along the path.

Steam profiles were plotted at various time intervals which in principle were the dividing line between fluid that contained very little steam and fluid that was 100% hot water and bitumen. In the same figures 120° C. profiles were plotted since this is believed to be the lower temperature limit for the flow of Athabasca bitumen emulsion in situ and the volume between the steam and 120° C. profile also defines the boundary of the bitumen in hot water emulsification process.

Shortly after steam injection began, an upwards steam communication channel developed in the tar sand at the front end of the simulator. By 200 minutes, the upper thermocouple readings at the front end were very close to the communication path temperature. By 260 minutes this same situation has advanced to the 1.3, 1.4 and 1.5 thermocouples indicating horizontal flow parallel to the communication path flow. This horizontal steam containing fluid flow seems to continue into the hot water zone and the vertical leg of the steam profile moves approximately 20 cm from FIG. 10 to FIG. 11 while a high oil cut is being produced. At the same time the 120° C. profiles have also moved both horizontally and vertically and the bitumen mobilization volume between the boundaries of the steam and 120° C. profiles is greater in FIG. 11 than in FIG. 10.

However, the steam profiles in the production end of the simulator show very little vertical movement until FIG. 14. This is because there is a flow of cooler O/W emulsion from the bitumen mobilization zones into the communication channel which prevents the steam zone from expanding. Unfortunately, hot water pressures are not related to temperature and actual pressure probe measurements would be needed to confirm the above hypothesis.

Based on the above observations and data it was concluded:

1. Most of the bitumen mobilization and the associated thermal conformance development occurred in the zones between the steam and 120° C. thermal profiles which contained no steam while the hot water temperature varied from 120° C. to 190° C. The 80% quality steam provided the necessary thermal and mechanical energy plus the hot water but generally did not contact the tar sand until after the preceding hot water had reduced the bitumen saturation.
2. The hot water temperature has not been optimized but the average temperature of about 150° C. correlated with good production in the field. It is highly probable that hot water plays a major role in all steam in situ processes that efficiently recover bitumen at relatively low reservoir temperatures.
3. The data support the hypothesis that most of the bitumen is mobilized and transported as a bitumen in water emulsion even when the observed bitumen production has coalesced to form a water in bitumen emulsion.
4. The bitumen in water emulsion is created in the porous sand by hot water under certain temperatures, produced oil cut, pressure gradient and reservoir bitumen saturation constraints without the addition of additives.
5. When the fluid communication path is occupied by an estimated 7 cp emulsion, the injected steam and hot water which have much lower viscosities are able to develop both thermal and recovery conformance in the reservoir away from the communication path.
6. There has been defined an efficient bitumen recovery process that operates at lower reservoir temperatures than is believed necessary for cyclic steam or steam flow bitumen recovery.

Successful in situ bitumen recovery projects based on steam injection present a problem in that the bitumen mobilization interface moves into the colder immobile bitumen at a higher velocity than can be accounted for by heat flow from a steam zone. Since engineers inject steam and produce bitumen, they believe that low viscosity steam provides additional bitumen mobilization due to concepts, such as steam drag and gravity drainage. This is contrary to the conclusion that most of the bitumen mobilization takes place beyond the steam condensate interface and the 120° C. thermal contour. The 120° C. contour is considered to be the bitumen mobilization interface and is the minimum temperature for the flow of bitumen in water emulsion in tar sand. The 120° C. contour moves radially from the central communication path at a much higher velocity than would be provided by heat flow alone.

Herein these are combined data from a separate hot water run in the same simulator. Hot water at 180° C. was injected at a rate of 10 kg/hr. Between 300 minutes and 400 minutes the upper and lower 120° C. profiles separated at a rate of 12.4 mm/hr. while the pressure drop across the one meter simulator was 80 kPa. The average velocity of a single 120° C. profile would be 6.2 mm/hr. Turning to FIGS. 10 and 11, we see at the 3 bank of thermocouples that the upper and lower 120° C. profiles move up 60 mm and down 15 mm for a total separation of 75 mm in one hour. The horizontal pressure drop at 260 minutes from thermocouples 0.3 to 6.3 using steam saturated vapor pressure was 63 psi. The distance from 0.3 to the 6.3 thermocouple is 94 cm. This gives a gradient of 67 psi per meter. This converts to 470 kPa per meter. Because of the upwards asymmetry of the steam drive we will once again take one half of the separation rate to obtain 37.5 mm per hour for the velocity of a single 120° C. contour if, for example, the simulator were vertical and the steam chamber were symmetrical at the upper end of the simulator. If the contour velocity of the hot water run is multiplied by $$\frac{470\ \text{kPa}}{80\ \text{kPa}}$$

there is obtained $$6.2\ \text{mm/hr} \times \frac{470}{80} = 38.8\ \text{mm/hr}$$

which is close to 37.5 mm per hour. This indicates that the velocity of the bitumen mobilization interface is proportional to the pressure gradient parallel to the interface, see also U.S. Pat. No. 4,884,635 and the paper of B. I. Nzekwa, R. J. Hallan and G. J. J. Williams entitled "Interpretation of Temperature Observations from a Cyclic Steam/In Situ Combustion Project" presented at the S.P.E. California Regional Meeting held in Long Beach, Calif., Mar. 23–25, 1988.

It is believed that the steam condensate forms a bitumen in water emulsion in the following manner. The 20% oil cut emulsion in the communication path has an apparent viscosity of the 7 cp which is much higher than the viscosity of steam or hot water. The steam and hot water are diverted into the tar sand and are able to penetrate tar sand zones with high bitumen saturation provided the condensate and emulsion are able to escape back to the communication path. The bitumen entrainment begins to take place when the bitumen temperature reaches the critical temperature (Tc) which is the minimum temperature required for stable flow of the O/W emulsion in the sand. At this temperature the viscosity of the bitumen has been reduced and the pressure gradient in the flowing emulsion is able to generate a little bitumen movement in the saturated pores. One can visualize small droplets of bitumen forming at pore throats and being entrained in the flowing emulsion. The magnitude of the pressure gradient will influence the rate of entrainment and the resulting oil cut. Most of the bitumen entrainment will occur in the volume between the critical temperature isotherm and the steam condensate interface as observed herein and in the paper of A. S. McKay and D. A. Redford entitled "A Basic Study of the Interaction of Steam, Hot Water and Oil in Water Emulsion when Steam is Injected in a Physical Simulator Packed with Athabasca Tar Sand", presented at the Second Latin American Petroleum Engineering Conference held Mar. 8–11, 1992 in Caracas, Venezuela. For the first time we have identified the importance of steam condensate in mobilizing bitumen.

Before interpreting the Midway-Sunset field data, see the paper of J. V. Vogel entitled "Simplified Heat Calculations for Steamfloods", pages 1127–1136 of the July 1984 issue of Journal of Petroleum Technology, there is need to mention the limited data on the variation of Tc with the viscosity of bitumen Tc for Athabasca bitumen is 120° C. and the viscosity at this temperature is 100 cp. For Wolf Lake production Tc is 100° C. and the viscosity at this temperature is also 100 cp. It is possible that Tc for Midway Sunset would also be the temperature where the viscosity would be 100 cp and oil would stop flowing into the production well. The above-cited Vogel paper would suggest that in the light of this invention that Tc could be around 170° F.

Figure 16:
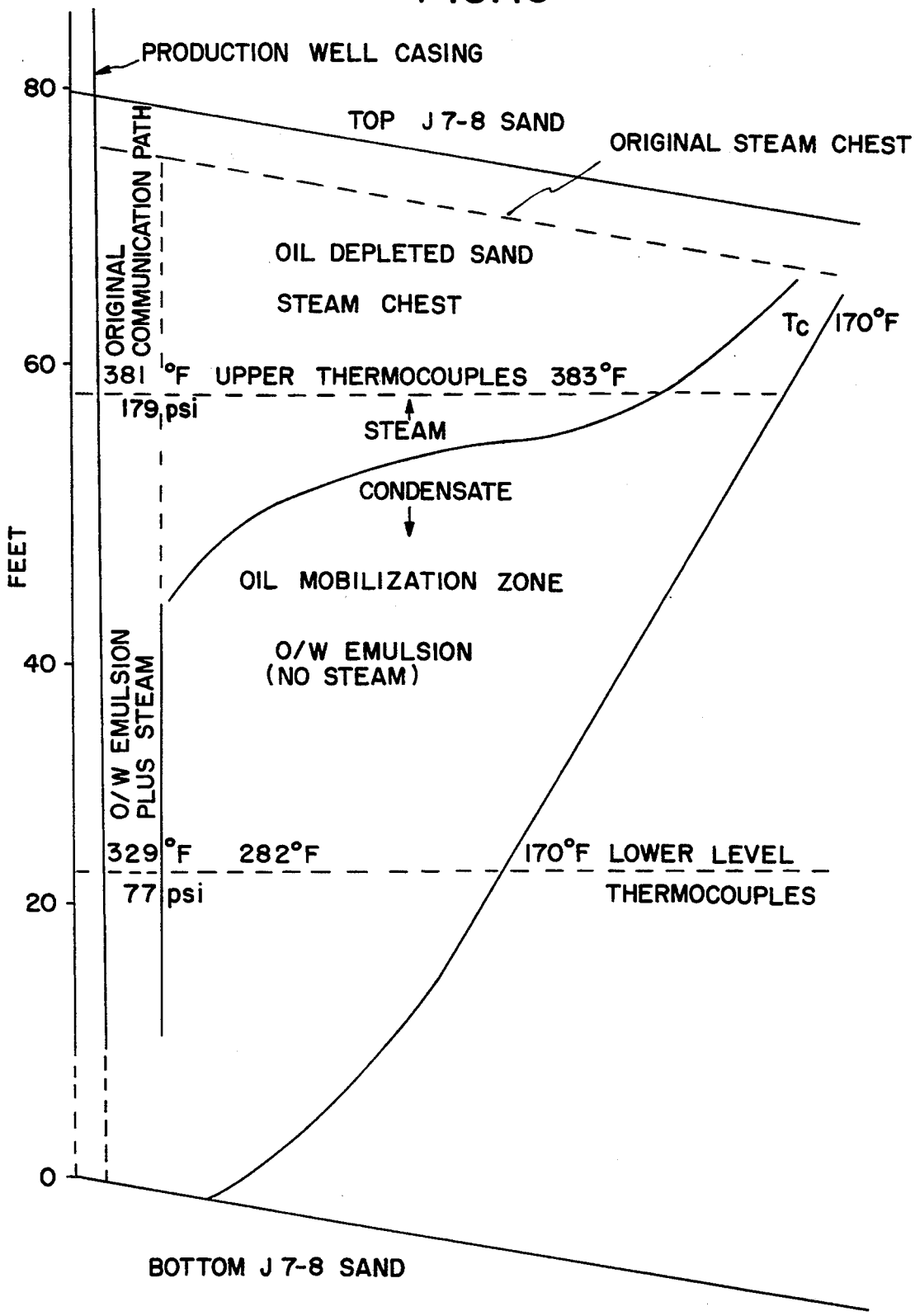

In FIG. 16 an oil recovery model has been constructed which honors the temperature data presented in the above-cited J. V. Vogel publication reference. There is a hot emulsion flow path just outside the casing of the production well that runs from the high pressure steam chest down to the well perforations. The sand in this flow path has a reduced oil saturation and the temperature is always above Tc (170° C.) The fluid in the flow path will usually consist of a mixture of oil in water emulsion and steam which makes it possible to convert temperatures to fluid pressures. If a 30% oil cut is produced the communication path fluid will have a viscosity around 5 cp which diverts most of the low viscosity steam and hot water away from the communication path. Most of the oil mobilization takes place below the steam condensate interface. The steam occupies the oil depleted zone and the steam temperature and pressure is controlled by the temperature and pressure of the communication path fluid. The low viscosity steam apparently moves readily through the oil depleted steam zone and at a certain level has a remarkably uniform temperature.

Looking at the lower temperature we can see a single high temperature of 322° F. which probably lies in the communication path. At the upper level 380° F. converts to 179 psi. At the lower level 329° F. converts to 77 psi so the ΔP between the two levels in the communication path is 102 psi. At the lower level any temperature significantly below 329° F. would lie outside the communication path and would not contain steam, as for example the reading of 282° F. It is suggested that the above-cited J. V. Vogel publication reference does not suggest that hot water with a temperature above Tc (170° F.) moves through the undepleted reservoir with a low viscosity and a significant pressure gradient. In any event the area enclosed by the lower level 170° F. contour in FIG. 16 is much greater than the area of the communication path that contains steam.

One of the characteristics of the subject recovery process is that the oil or bitumen production rate remains essentially constant over extended periods. This is observed in the above-cited A. S. McKay and D. A. Redford reference and also in the publication of N. R. Edmunds, J. A. Kovalsky, S. D. Gittens and E. D. Pennacchioli; Alberta Oil Sands Technology and Research Authority, Review of the Phase A Steam Assisted Gravity Grainage Test: An Underground Test Facility. Proceedings of the 1991 SPE International Thermal Operations Symposium, Feb. 6–8, 1991, Bakersfield, Calif. It would be important to determine the maximum distance of Tc from the production well. This could be done by following the movement of the steam condensate and Tc contours at the upper level and the movement of Tc at the lower level over the complete production history. This information would be very helpful in planning programs for additional recovery.

Based on the limited temperature field data available in the above-cited J. V. Vogel publication, we can still make a rough estimate of the oil production rate of the production well. It will be assumed that the Tc contour is a vertical cylinder with a length of 20 meters and a radius of 20 meters. The 380° F. steam condensate interface is at the top of the cylinder down to the well completion where it is assumed a production fluid temperature of around 212° F. with a bottom hole pump. The ΔP across the communication path is 380° F.–212° F. or 179 psi–Opsi–179 psi. The pressure gradient is $$\frac{179 \text{ psi}}{20 \text{ meters}} = 8.95 \text{ psi/meter}$$

From the first section of this report 67 psi/meter moves Tc 0.912 meters/day. 8.95 psi/meter gives $$0.912 \text{ meters/day} \times \frac{8.95}{67} - 0.122 \text{ meters/day}$$

The surface area of Tc cylinder—$225\pi \times 20$ meters=2513 $m_2$. Additional volume included by Tc in one day=2513×0.122 meters/day—306.6 $m^3$/day. If it is also assumed a porosity of 30% initial oil saturation of 70% and a residual oil saturation of 30%, it is estimated that the oil production would be 36.8 m/day or 232 bbls/day. This calculation also assumes that oil is being produced from the oil mobilization zone between the steam condensate interface and Tc at the same rate as oil enters the mobilization zone by the movement of Tc. However, all of the assumptions can be quantified by analysis of field data.

This same model and method of analysis can be applied generally to steam flood or gravity drainage projects in tar sands and heavy oil reservoirs and in most of these projects a better understanding of the oil mobilization process should lead to both increased recovery and higher oil production rates.

The production rate is independent of the level of the steam condensate interface at the side of the hot chamber because the velocity of the Tc contour is proportional to the pressure gradient in the condensate. This explains the unexpected result that the bitumen production rate did not change when the steam trap settings varied from 10 to 40 degrees of subcooling which also varied the level of the steam condensate interface.

How both increased bitumen recovery and increased bitumen production rates can be achieved by simple changes in operating procedures is explained. Apparently the steam condensate interface was in the lower portion of the active chamber and was close to the production well most of the time. It had been believed that steam drag and gravity drainage mobilizes and transports the bitumen to the production well from the upper steam zone. This results in concentrating the bitumen recovery from the lower part of the chamber contacted by the condensate. Significantly greater recovery would be obtained if the steam condensate interface were maintained at a higher level. This would be also make it possible to increase the ΔP between the well because of the steam coning problem. If ΔP were increased 50% to 300 kPa the bitumen production rate would also be increased about 50%. The production rate could also be increased by lowering the steam quality so the produced oil cut would be less than 30% which would significantly reduce the viscosity of the bitumen in water emulsion. The steam quality should be reduced gradually after the steam zone reaches the top of the reservoir. This would slow down the growth of the steam zone mushroom cap and also reduce the steam coning effect which would make it possible to increase the ΔP. The ultimate bitumen recovery depends on the thickness of the viscous O/W plus steam layer and the bitumen recovery process itself terminates when the viscous layer is replaced by low viscosity steam.

The concepts of steam drag and gravity drainage are still used by both field engineers and research scientists but this results in inefficient field operations and premature termination of production as steam zones develop over significant horizontal areas. Belief in these concepts has also hindered research into understanding the bitumen mobilization and transport processes. These observations apply to experimental pilot operations in the past. However, by this invention bitumen mobilization and transport technology that can significantly lower the in situ recovery costs of heavy oil and bitumen.

A review of the above-cited J. V. Vogel's publication entitled Simplified Heat Calculations for Steamfloods using the bitumen or heavy oil recovery process identified in the analysis of the one meter simulator data accounted for the increased oil recovery without any evidence of gravity drainage or steam drag. Most of the oil mobilization took place below the steam condensate interface. This same recovery process could be used in a single well which would have a significant saving in heat loss compared with the continuous steam chest covering 38 acres, but lack of steam blows and declining productivity in the second row of producers indicated that the downdip heat blanket was cooling off. Only a part of the continuous steam blanket was effective in that the oil mobilization was limited to the reservoir in the vicinity of the production wells. Nothing was done about the declining productivity in the second row of producers.

It has been discovered that the velocity of the Tc contour is proportional to the pressure gradient. This is an indirect indication that the produced oil cut could be proportional to the ΔP between the injection and production points and substantially independent of the communication path length. Other more direct evidence exists in comparing produced oil cuts and ΔP's from both the 30 cm simulator and the meter simulator. In tests an excellent correlation of oil cut and ΔP for the hot water plus $CO_2$ recovery system has been observed. A ΔP of 250 kPa (36 psi) produces a 10% oil cut in the 30 cm simulator. The carbon dioxide reduced Tc from 120° C. to 100° C. and may have also reduced the ΔP necessary to produce a 10% oil cut. However, when 80% quality steam is injected in the one meter simulator a ΔP of 80 psi produces a 20% oil cut which is due to bitumen mobilization by the steam condensate. This supports the hypothesis that the oil cut is proportional to ΔP and independent of the length of the communication path. Tests indicate that ΔP is a primary parameter in controlling the produced oil cut and that a ΔP of 40 psi should produce a 10% oil cut when operating a relatively low temperature hot water or steam bitumen or heavy oil recovery process even when the pressure gradient varies as in radial flow.

Figure 17:
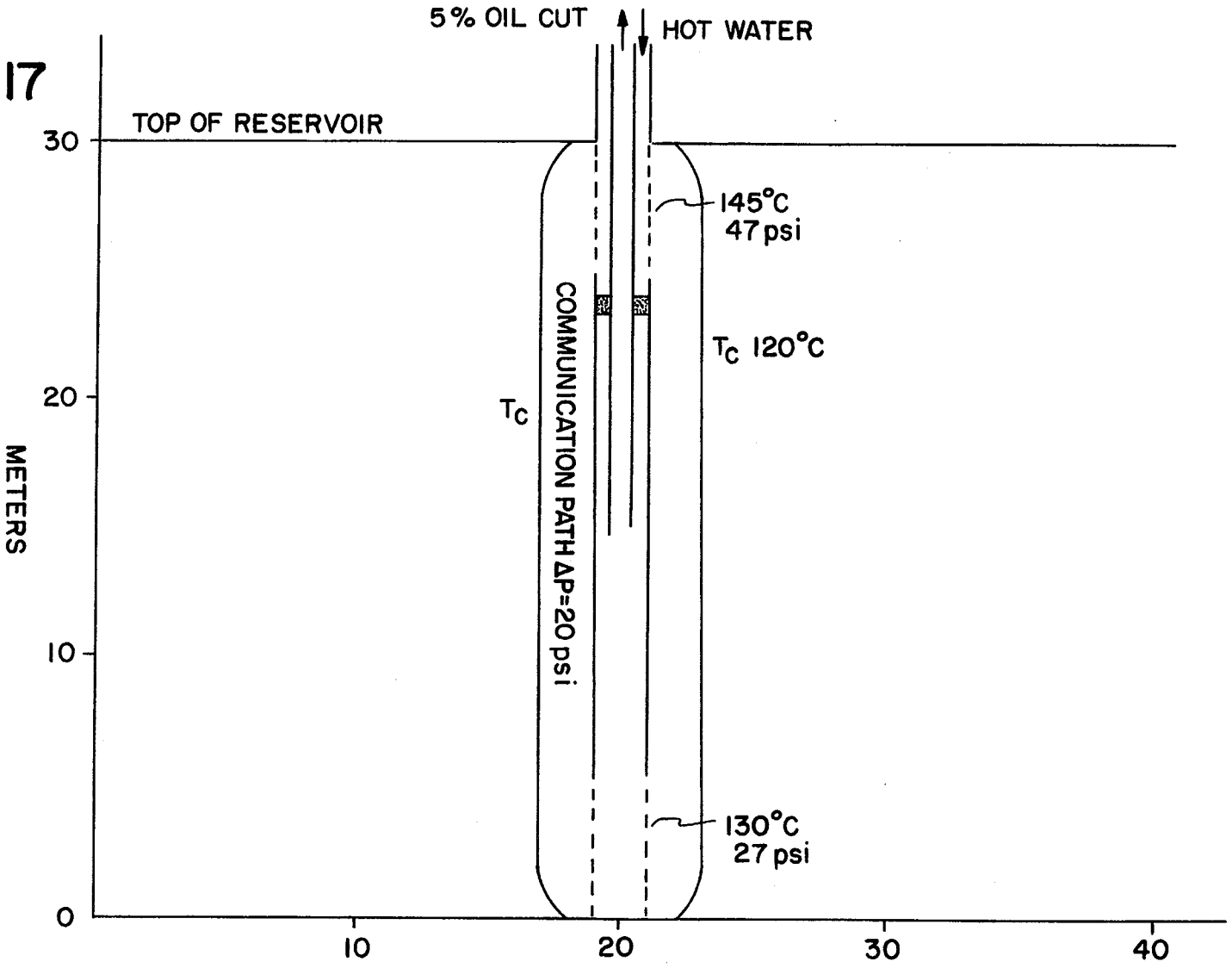

When applied to Athabasca bitumen recovery by a single well, referring to FIG. 17, it is necessary first to establish fluid communication through the reservoir between the upper and lower well completions. This requires circulation of high temperature steam inside the casing long enough to create a continuous zone outside the casing with a temperature above 130° C. It should then be possible to force hot water through this zone between the well completions.

Hot water injection should continue in order to establish a significant communication path between the upper and lower well completions that is filled with a relatively high viscosity bitumen in water emulsion with an oil cut of at least 5%. The lower well production fluid should be higher that Tc (120° C.), such as 130° C. with a steam saturated vapor pressure of 24.5 psi. In order to produce a 5% oil cut the injection pressure should be 20 psi +24.5 which equals 44.5 psi and a hot water temperature of 145° C. to give a ΔP of 20 psi while the production pressure is 24.5 psi to give a ΔP of 20 psi. This provides a guideline for the actual hot water recovery operation where both the upper injection pressure and the bottom production pressure must be above the steam saturated vapor pressure for a hot water recovery system. In FIG. 17, both injection and production pressures are 2.5 psi above the steam SVP. The production fluid temperature should be around 130° C. because the steam recovery phase will operation at lower injection temperatures and pressures if the production fluid temperature is kept down to 130° C. In addition, the hot water temperatures will be close to the initial fluid temperatures when converting to steam injection.

In order to convert to steam injection, increase the oil cut from 5% to 20% by injecting 60% quality steam at the same mass rate as the hot water rate. In order to produce a 20% oil cut the ΔP should be 80 psi. The saturated steam pressure should be 80+25=105 psi which would require a steam temperature of 172° C. When the system stabilizes the bottom hole production temperature should still be around 130° C. although a small rise would not seriously reduce the thermal efficiency of the process.

Next increase the oil cut to 25% which would require a ΔP of 100 psi and a steam SVP of 150 psi. The steam temperature should be increased to 178° C.

If a stable production of a 25% oil cut is obtained, the steam temperature could be gradually increased to 184° C. which should provide a 30% oil cut. If the oil cut fluctuates, this indicates that resaturation is occurring and the oil cut should be reduced to 25%.

When the same above-described application of ΔP is applied to the operations of the above-cited J. V. Vogel publication data, it is seen that Tc is 170° F. and no back pressure is required at the bottom of the production well. This means that a 30% oil cut would require a ΔP of 120 psi or a steam temperature of 177° C. (351° F.). This temperature is only 7° C. lower than the 184° C. steam temperature required for a 30% oil cut from Athabasca bitumen. If the back pressure to control the steam blows were available along with the temperature of the steam chest and the produced oil cut, a better value for the ΔP versus oil cut relationship could be obtained. It may be that differences in porosity and vertical permeability could modify the relationship derived from Athabasca tar sand.

Figure 18:
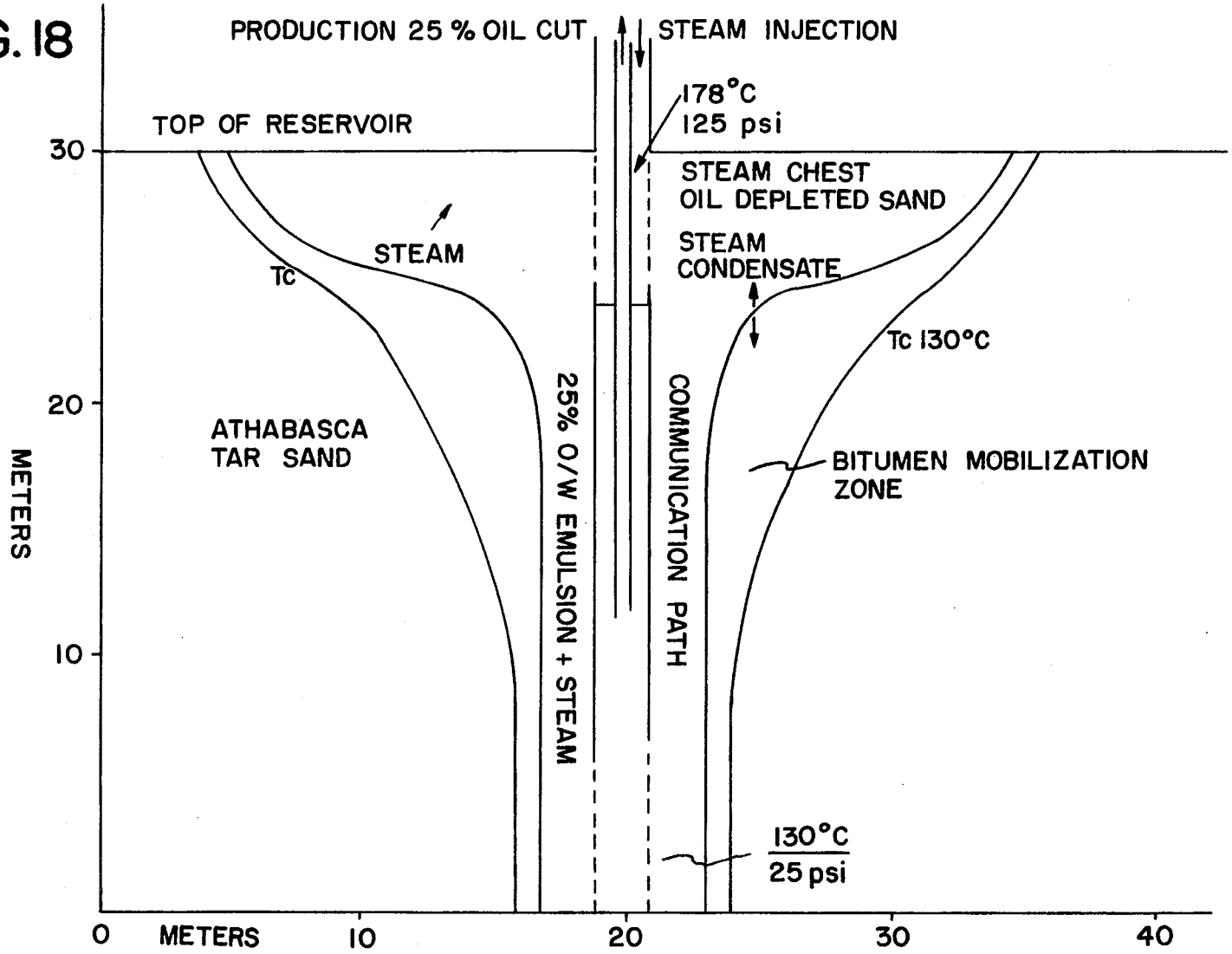

The single well process is very attractive for the production of bitumen from shallow Athabasca tar sands because of the relatively low steam temperature and pressures that are necessary. Where the tar sand reservoir has an impermeable upper boundary the process would work with as little as 200 feet of overburden which should contain the 125 psi injection pressure in FIG. 18. This could recovery bitumen at lower cost and reduced environmental damage as compared to strip mining. The process could also be applied to mature steam floods where steam filled communication 10 paths have linked injection and production wells and have left behind massive volumes of undepleted tar sand in the intermediate zone between the wells. The steam zone can be converted to a hot water bitumen emulsion zone and then steam is once more injected behind the high viscosity fluid in the communication path. Another alternative is to drill infill wells and use the steam chest as outlined in the single well process described herein.

Since the bitumen is mobilized by hot water, the addition of $CO_2$, synthetic crude or surfactants could reduce Tc to 100° C. and reduce the injected steam pressure to 100 psi.

Figure 19:
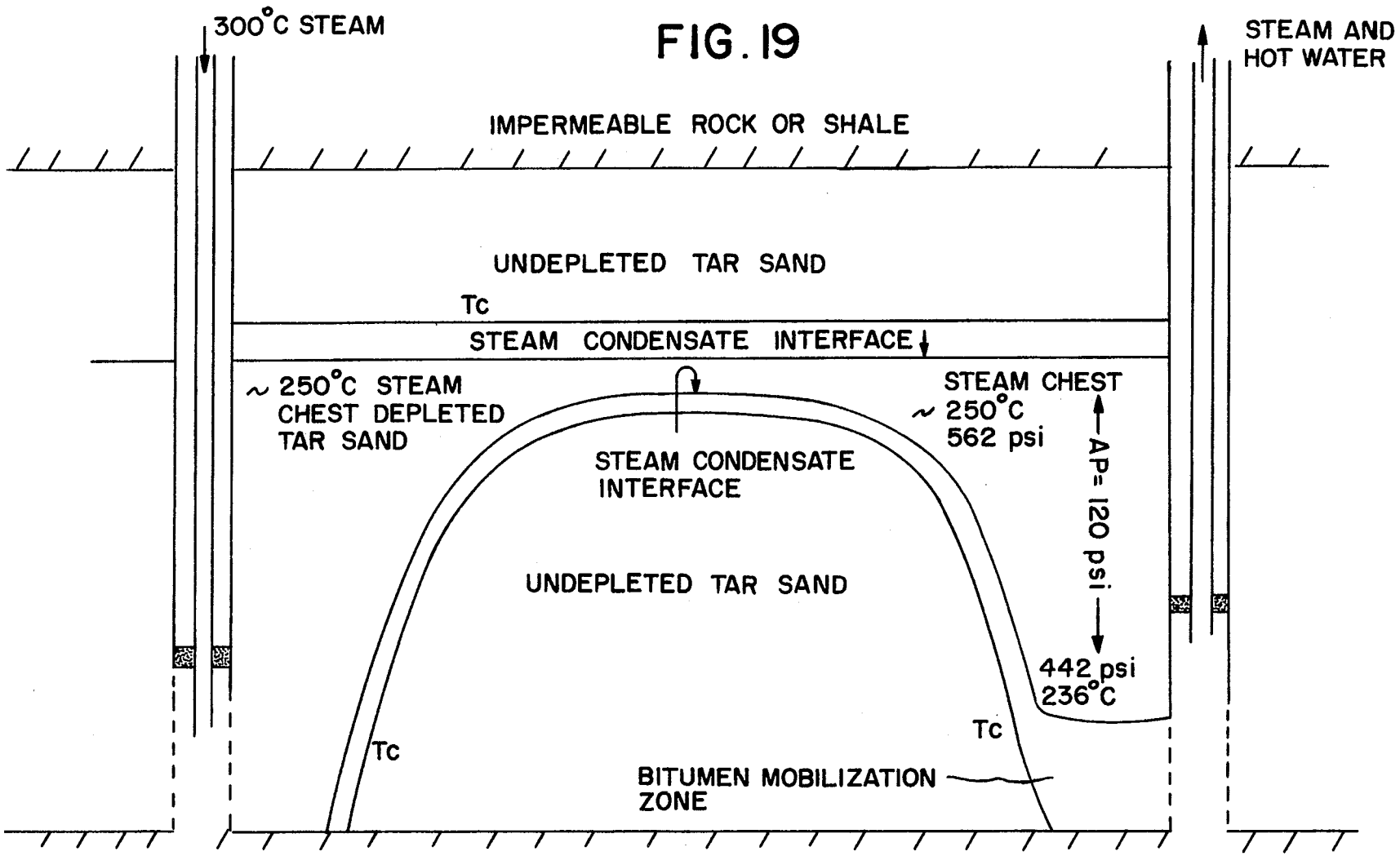

High temperature steamfloods or cyclic steam operations rarely recover more than 15 to 20% of the bitumen in place in Alberta. The high temperature steam breaks through to the producing well completions and bitumen production is terminated. At this point there is no help from steam drag or gravity drainage. The ΔP across the steam filled communication path is quite small. In FIG. 19, there is illustrated a reservoir condition that could exist when high temperature steam is about to break through into the production well. In addition, the discovery in the single well process that the produced oil cut is proportional to the ΔP between the upper and lower well completions is also used which also involves an extrapolation to greater communication path distances in steamflood operations. The available field data indicates that for a given ΔP, say 120 psi, the produced oil cut is 30% and that this is independent of the communication path length when the bitumen is mobilized by hot water.

The first step is to stop injecting steam and draw down the reservoir steam pressure by producing steam and hot water. Eventually good bitumen production will occur as relatively high viscosity O/W emulsion begins to occupy the steam communication path. The initial produced oil cut should be above 30% which indicates that the ΔP is above 120 psi. The draw down should continue until the oil cut falls to 10% with a corresponding ΔP of 40 psi. At this point the O/W emulsion should extend from the production well and past the lower undepleted tar sand. Both wells should be recompleted over the total depth of the reservoir and would then be ready to inject steam thereinto and begin a low temperature steamflood as illustrated in FIG. 20.

Figure 20:
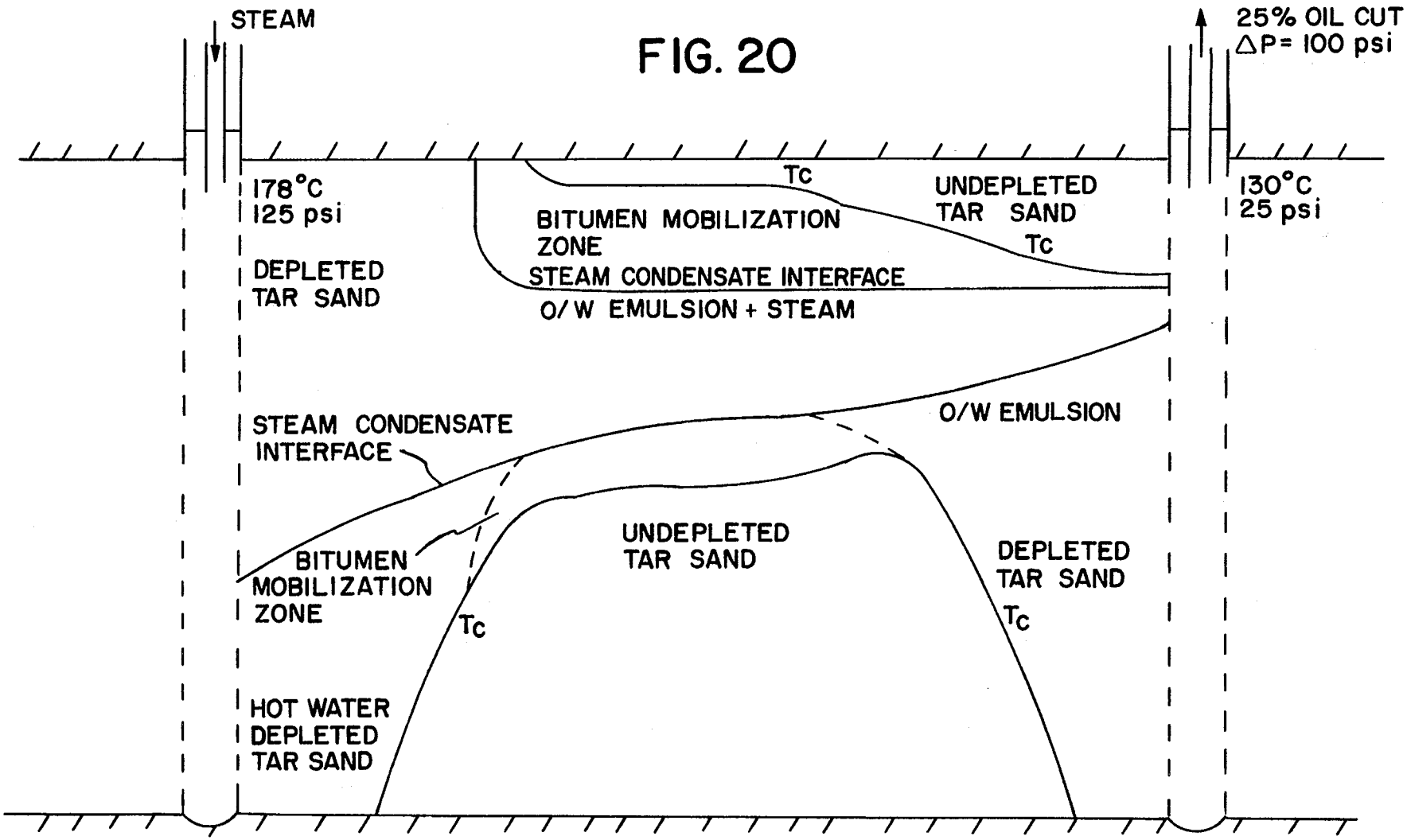

FIG. 20 shows additional depleted tar sand and active bitumen mobilization zones after the recovery process has continued for a significant period producing a 25% oil cut.

There is a significant loss of energy in the first stage of the pressure down process and there has also been an unnecessary heat loss due to the high temperature of the active reservoir and the produced fluids. All of these losses can be reduced if the low temperature recovery process were initiated in the first place. The injection and production well would be completed over the entire reservoir interval as illustrated in FIG. 20. Very often a tar sand reservoir has existing fluid communication paths due to intervals of reduced bitumen saturation. One or more of these intervals should accept low viscosity hot water at a sufficient rate to establish a bitumen emulsion flow path with a temperature above Tc (120° C.) at the bottom of the production well. Hot water injection should continue to produce a bitumen emulsion and enlarge the communication path if necessary. At this point steam can be injected as in FIG. 20 to produce a 25% oil cut. This recovery process will operate regardless of the location of the one or more communication paths because bitumen mobilization takes place both above and below and horizontally around the initial communication paths.

The application of the oil-in-water emulsion technology technique of this invention and the discovery that the produced oil cut is proportional to the pressure differential ΔP across an-oil-in-water occupied communication path are described as applied to the recovery of bitumen. In this field scale analysis, it is assumed that ΔP of 45 psi will produce a 10% oil cut in order to allow for the pressure drop across the producing well completions since laboratory simulator data indicated that ΔP of 40 psi would produce a 10% oil cut. The analysis indicates that very little bitumen was produced when the bottom hole temperature was above 160° C. and this situation also was accompanied by very high gas to produced oil ratios. Evidently, there was no steam trap control during the production phase and when steam was produced it also provided a good communication channel for gas. The best bitumen production occurred when the bottom hole temperature was in the range 100° C. to 110° C. which indicates the communication path in the vicinity of the well was occupied by an oil-in-water emulsion containing little or no steam. The gas oil ratio (GOR) was also relatively low which means that the relatively high viscosity oil-in-water emulsion while moving through the porous sand was able to reduce the GOR to a very low value. This means that the formation gas pressure can also contribute to increasing the oil cut of the oil-in-water emulsion by increasing the ΔP across the emulsion.

The analysis indicates that high produced GOR plus the loss in effective steam ΔP, both steam and gas fingered or channeled through the lower viscosity low oil cut emulsion. The analysis also indicates that as the fluid pressure decreases along its communication channel, the hot water can only slowly vaporize through evaporation through the watersteam interface. When the steam SVP is greater than the gas pressure the water can boil or flash into steam. This can create a continuous steam communication path and cool the steam occupied pore space. This appears to explain why the subject bitumen recovery process is so efficient and provides a low GOR.

In an actual well injection 20,357 $M^3$ of steam was completed. Several attempts were made to produce over the next year but each time there was high GOR and low bitumen production and relatively high bottom hole temperatures.

Analysis of field data found that the bitumen was mobilized by hot water beyond the steam condensate interface and the pressure gradient in the communication path occupied by relatively high viscosity oil-in-water emulsion provided steam and hot water diversion into the bitumen containing tar sand which does not exists if the communication path contains a continuous low viscosity steam or gas channel.

The analysis showed this same process could explain the so-called gravity draining process on the basis of partial pressure drops across an emulsion filled communication path around the vertical casing of the production well. In fact, a process that could be called emulsion diversion could replace the concepts of gravity drainage and steam drag.

It was observed, as disclosed hereinabove, that the oil cut should be proportional to the ΔP across the length of the emulsion filled communication path regardless of the length of the path and is consistent with the available data.

In this invention there has been identified and quantified the parameters of a novel low temperature bitumen or heavy oil recovery process that can be applied to all types of processes that involve steam or hot water, e.g. cyclic steam and steamflooding, in bitumen or heavy oil production and recovery operations.

The practices of this invention involve in one embodiment, as described herein:

1. Establishing a hot water communication path through a high bitumen or heavy oil saturation reservoir that connects a hot water injection with a hot water production zone and establish a stable production of a 5% to 10% bitumen or heavy oil cut by adjusting the injection hot water temperature and injection rate to raise the production fluid temperature above Tc and also provide the necessary pressure drops to give the desired oil cut which preferably should be around 10%.
2. While continuing to inject hot water gradually simultaneously inject increasing amounts of a chemically inert and non-corrosive gas until the oil cut increases to 20% while also increasing the temperature of the injected water to maintain the bottom hole temperature of the produced fluid above Tc.
3. After 20% oil cut production has stabilized, continue to increase the gas injection rate and the temperature of the injected hot water in order to raise the produced oil cut to 30% and maintain the produced fluid above Tc. When the gas pressure is greater than the steam SVP, the produced gas to oil ratio should be quite low which would provide an economic advantage. In addition, the relatively low temperature hot water would not require the investment for a steam generator and the produced hot water would be recycled. Most importantly, the process would use less energy per $M^3$ or bitumen of heavy oil produced. In addition, if other zones are encountered, the oil-in-water emulsion would seal them off as the temperature of the emulsion fell below Tc.

When the reservoir contains gas, the initial hot water communication channel production fluid should have a back pressure equal to the reservoir gas pressure. The development of production will proceed with gradual reduction of the production back pressure being replaced by the injection of gas. If the reservoir gas pressure were above 135 psi, the produced oil cut would suddenly increase above 30% when the production temperature rises above Tc and would probably resaturate and plug the communication path.

The injection of $CO_2$ would lower Tc by as much as 20° C. and would allow the recovery process to operate at a lower temperature.

The gradual addition of surfactants, while keeping the oil cut below 30%, could also lower Tc. A high aromatic content oil, such as synthetic crude, has been found to be very effective in lowering Tc and also in reducing the residual bitumen or heavy oil saturation.

What is claimed is:

1. In an oil or bitumen producing operation wherein the oil or bitumen is produced and recovered from an underground formation as oil or bitumen and water, the improvement which comprises producing said oil or bitumen from said formation at a temperature above the temperature Tc wherein the temperature Tc is the minimum temperature for the oil or bitumen, in the form of of an oil-in-water emulsion to flow through said formation from which said oil or bitumen is produced and maintaining the temperature of the produced oil or bitumen during production at a temperature greater than Tc.

2. In an operation in accordance with claim 1 for the production and recovery of oil or bitumen, maintaining the temperature of the produced and recovered oil or bitumen during production a temperature greater than Tc by introducing into the formation producing said oil or bitumen hot aqueous fluid, at a temperature substantially greater than the temperature Tc whereby the temperature of the produced oil or bitumen is maintained at a temperature greater than Tc.

3. A method in accordance with claim 1 wherein the produced and recovered oil from said formation is produced and recovered along with water and wherein the oil or bitumen content is greater than 10% by weight or volume.

4. A method in accordance with claim 1 wherein carbon dioxide is introduced into said formation.

5. In the production of oil or bitumen from an underground formation containing said oil or bitumen in the presence of water or wherein said oil or bitumen formation is in direct contact with a water-containing or producing formation and wherein a hot aqueous fluid is introduced into said oil or bitumen-containing formation to move or drive the oil or bitumen therein to a production well for recovery and wherein after a period of time substantially only aqueous fluid at a temperature Td is produced and recovered at said production well with no substantial production of oil or bitumen, the improvement which comprises introducing hot water or steam into said oil or bitumen-containing formation to drive or produce additional oil or bitumen from said formation toward and into said production well for recovery therefrom, the temperature of the thus-produced oil or bitumen being at or above the temperature Tc, Tc being higher than the temperature Td and being the minimum temperature for the produced oil or bitumen, in the form of an oil-in-water emulsion, to flow through the formation from which the oil or bitumen is produced through said production well and maintaining the temperature of thus-produced oil or bitumen recovered at said production well at a temperature not lower than or greater than the temperature Tc.

6. A method in accordance with claim 5 wherein a surfactant is introduced into said oil or bitumen-containing formation into which said hot water or steam is introduced.

7. A method in accordance with claim 5 wherein a petroleum fraction containing aromatic hydrocarbons in a minor amount or liquid aromatic hydrocarbons are introduced into said oil or bitumen-containing formation into which said hot water or steam is introduced.

8. A method in accordance with claim 5 wherein carbon dioxide is introduced into said oil or bitumen-containing formation into which said hot water is introduced.

9. A method in accordance with claim 5 wherein an agent is introduced into said oil or bitumen-containing formation into which said hot water or steam is introduced to reduce the temperature Tc.

10. A method in accordance with claim 5 wherein said steam is mixed with water.

11. A method in accordance with claim 5 wherein the temperature of the hot water or steam introduced into said oil or bitumen-containing formation is in the range 100°–350°C.

12. A method in accordance with claim 5 wherein carbon dioxide is introduced into said formation.

13. A method of operating a vertical well comprising a production tubing and a surrounding casing penetrating a porous, water containing oil or bitumen producing formation for the production via said well of oil or bitumen from said formation which comprises circulating high temperature steam inside the well casing to heat an annular zone in said formation outside said well casing to a temperature greater than the temperature Tc, Tc being the minimum temperature for the produced formulated water and oil in the form of an oil-in-water emulsion to flow through said porous water and oil producing formation, completing said well over intervals at the top or upper portion of said casing into said formation and at the lower or bottom portion of said casing into said formation, introducing hot water into said formation to flow therein between said upper and lower portions about said well within said formation to reduce the oil or bitumen saturation therein and to create an oil-in-water emulsion flow path at a temperature to produce oil or bitumen having an oil cut between about 25% to about 35% when the pressure differential between the upper portion and the lower portion of said formation surrounding said well is in the range from about 100 psi to about 140 psi while maintaining the produced oil or bitumen temperature comprising oil-in-water emulsion at a temperature greater than Tc.

14. A method of converting a mature high temperature steam flood for the production of oil or bitumen from an underground porous, water-containing and oil or bitumen containing formation wherein high temperature steam is introduced into one portion of the formation to drive oil or bitumen within said formation to another portion thereof for recovery which comprises interrupting the introduction of high temperature steam into said one portion of said formation, permitting the steam pressure within said formation to drop and recovering oil or bitumen from said other portion of said formation until the produced oil cut falls to about 10%, thereupon introducing relatively low temperature, low pressure steam into said one portion of said formation to create a pressure drop between said one portion and said other portion of said formation in the range from about 100 psi to about 140 psi while producing said bitumen from said other portion of said formation as a bitumen or oil-in-water emulsion having an oil cut from about 25% to about 35%, the produced oil-in-water emulsion being maintained at a temperature greater than Tc, Tc being the minimum temperature for water and oil or bitumen in the form of an oil-in-water emulsion to flow through said formation.

* * * * *